US007714510B2

(12) United States Patent
Ryu et al.

(10) Patent No.: US 7,714,510 B2
(45) Date of Patent: May 11, 2010

(54) PLASMA DISPLAY APPARATUS

(75) Inventors: Seong Nam Ryu, Busan-si (KR); Woo Gon Jeon, Gumi-si (KR); Sang Min Hong, Seoul (KR); Woo Tae Kim, Yongin-si (KR); Kyung A Kang, Busan-si (KR); Jeong Hyun Hahm, Seoul (KR); Jae Sung Kim, Gumi-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/704,336

(22) Filed: Feb. 9, 2007

(65) Prior Publication Data

US 2007/0279325 A1 Dec. 6, 2007

(30) Foreign Application Priority Data

May 30, 2006 (KR) ..... 10-2006-0048816

(51) Int. Cl.
*H01J 17/49* (2006.01)

(52) U.S. Cl. ..... 313/586; 313/582

(58) Field of Classification Search ..... 313/582–587; 345/37, 41, 60, 71; 445/24, 25
See application file for complete search history.

(56) References Cited

U.S. PATENT DOCUMENTS 6,034,474 A 3/2000 Ueoka et al. ..... 315/584
6,160,345 A * 12/2000 Tanaka et al. ..... 313/489
6,184,621 B1 2/2001 Horiuchi et al. ..... 313/586
6,407,503 B1 6/2002 Mizobata ..... 313/587
6,522,072 B1 2/2003 Yura et al. ..... 313/582
6,646,375 B1 11/2003 Nagano (Continued)

FOREIGN PATENT DOCUMENTS

CN 1319244 10/2001

(Continued)

OTHER PUBLICATIONS

European Search Report dated Nov. 12, 2007.

(Continued)

*Primary Examiner*—Peter J Macchiarolo
*Assistant Examiner*—Donald L Raleigh
(74) *Attorney, Agent, or Firm*—KED & Associates LLP

(57) ABSTRACT

A plasma display apparatus is provided that includes a front substrate, a plurality of first and second electrodes formed on the front substrate, a rear substrate that is faced with the front substrate, a plurality of third electrodes formed on the rear substrate, and a discharge cell that is disposed where the first, and second electrodes intersect with the third electrode, wherein at least one of the plurality of the first and second electrodes is formed with one layer, wherein a thickness of at least one of the plurality of the first and second electrodes ranges from 3 μm to 7 μm. By removing the transparent electrode consisting of ITO, the manufacturing cost of the plasma display panel may be reduced. Further, by forming projecting electrodes protruded to the opposite direction of the center of the discharge cell or in the direction of the center of the discharge cell from the sustain electrode line or the scan electrode, the firing voltage may be lowered, and the discharge diffusion efficiency in the discharge cell increased.

37 Claims, 19 Drawing Sheets

U.S. PATENT DOCUMENTS

| | | | | |
|---|---|---|---|---|
| 6,670,754 | B1 * | 12/2003 | Murai et al. | 313/582 |
| 6,734,626 | B2 * | 5/2004 | Yoshioka et al. | 313/585 |
| 6,828,731 | B2 | 12/2004 | Kang et al. | 313/587 |
| 7,002,296 | B2 * | 2/2006 | Sano et al. | 313/583 |
| 7,009,587 | B2 * | 3/2006 | Nishimura et al. | 345/67 |
| 7,045,962 | B1 * | 5/2006 | Murai et al. | 313/582 |
| 2002/0195939 | A1 * | 12/2002 | Okigawa et al. | 313/584 |
| 2004/0041522 | A1 * | 3/2004 | Takada et al. | 313/586 |
| 2004/0142623 | A1 * | 7/2004 | Joo et al. | 445/24 |
| 2004/0150340 | A1 * | 8/2004 | Son et al. | 313/582 |
| 2004/0183440 | A1 * | 9/2004 | Huang et al. | 313/582 |
| 2004/0256988 | A1 * | 12/2004 | Chang et al. | 313/582 |
| 2005/0029941 | A1 * | 2/2005 | Kwon et al. | 313/582 |
| 2005/0067959 | A1 * | 3/2005 | Jang et al. | 313/582 |
| 2005/0134176 | A1 | 6/2005 | Kwon et al. | 313/582 |
| 2005/0179382 | A1 * | 8/2005 | Kim | 313/582 |
| 2005/0236994 | A1 | 10/2005 | Kwon et al. | 313/584 |
| 2005/0242729 | A1 * | 11/2005 | Kweon | 313/586 |
| 2005/0264197 | A1 * | 12/2005 | Yoshinari et al. | 313/582 |
| 2005/0285524 | A1 * | 12/2005 | Tokai et al. | 313/582 |
| 2005/0285529 | A1 * | 12/2005 | Hwang et al. | 313/584 |
| 2006/0001371 | A1 | 1/2006 | Jang | 313/582 |
| 2006/0028139 | A1 * | 2/2006 | Son et al. | 313/586 |
| 2006/0028406 | A1 * | 2/2006 | Mizobata | 345/67 |
| 2006/0076877 | A1 | 4/2006 | Kim | |
| 2006/0113909 | A1 * | 6/2006 | Su | 313/582 |
| 2006/0113912 | A1 * | 6/2006 | Kim et al. | 313/585 |
| 2006/0181212 | A1 * | 8/2006 | Sawa et al. | 313/582 |
| 2006/0186812 | A1 * | 8/2006 | Su et al. | 313/582 |
| 2006/0226779 | A1 * | 10/2006 | Ahn | 313/583 |
| 2007/0029908 | A1 | 2/2007 | Goto et al. | |

FOREIGN PATENT DOCUMENTS

| | | |
|---|---|---|
| CN | 1581404 | 2/2005 |
| CN | 1622256 | 6/2005 |
| CN | 1725423 | 1/2006 |
| JP | 11-096924 | 4/1999 |
| JP | 11-283511 | 10/1999 |
| JP | 2003-031133 | 1/2003 |
| WO | WO 2005/043577 | 5/2005 |

OTHER PUBLICATIONS

Chinese Office Action dated Mar. 28, 2008.
European Search Report dated Oct. 26, 2009.

* cited by examiner

PLASMA DISPLAY APPARATUS

This application claims the benefit of Korean Patent Application No. 10-2006-0048816 filed on May 30, 2006, which is hereby incorporated by reference for all purposes as if fully set forth herein.

BACKGROUND OF THE INVENTION

1. Field of the Invention

The present invention relates, in general, to a plasma display apparatus and, more particularly, to a panel equipped in a plasma display apparatus.

2. Description of the Related Art

As to the plasma display panel, the barrier rib formed between the front substrate and the rear substrate forms one unit cell. Inside of each cell, a main discharge gas such as Ne, He, or Ne+He mixed gas and an inactive gas containing a small amount of xenon is filled. When a discharge is generated by a high frequency voltage, the inactive gas generates the Vacuum Ultraviolet rays, and stimulates the phosphor formed between the barrier ribs to display an image. Such plasma display panel can be implemented with a thin and light configuration, therefore, it is highlighted as future display device.

FIG. 1 is a drawing showing the structure of a plasma display panel of the related art. Referring to FIG. 1, as to a plasma display apparatus, a front panel 100 and a rear panel 110 is disposed in parallel with a constant distance. On the front panel 100, a plurality of sustain electrode pairs are disposed on a front substrate 101 where an image is displayed, when the sustain electrode pair is comprised of a scan electrode 102 and a sustain electrode 103. On the rear panel 100 which is a backside, a plurality of address electrodes intersecting with the plurality of sustain electrode pairs are disposed on a rear substrate 111.

The front panel 100 is comprises of a scan electrode 102 including a transparent electrode 102*a*, 103*a* and a bus electrode 102*b*, 103*b*, and a sustain electrode 103 while the scan electrode 102 and the sustain electrode 103 form a pair and a transparent electrode 102*a*, 103*a* is made of a transparent Indium Tin Oxide ITO. The scan electrode 102 and the sustain electrode 103 are covered with a front dielectric layer 104. The protective layer 105 is formed on the front dielectric layer 104.

The rear panel 110 includes a barrier rib 112 for partitioning off a discharge cell. A plurality of address electrodes 113 are arranged in parallel with the barrier rib 112. On the address electrode 113, Red R, Green G, and Blue B phosphors 114 are coated. A rear dielectric layer 115 is formed between the address electrode 113 and the phosphors 114.

In the meantime, the transparent electrodes 102*a*, 103*a* comprising the scan electrode 102 or the sustain electrode 103 is made of ITO which is expensive. Transparent electrode 102*a*, 103*a* causes the raising of the manufacturing cost of the plasma display panel. Therefore, manufacturing the plasma display panel which can obtain the sufficient color matching function and the driving characteristic for a user while decreasing the manufacturing cost is requested in recent days.

SUMMARY

Accordingly, the present invention has been made in view of the above problems occurring in the prior art, and it is an object of the present invention to provide a plasma display apparatus capable of improving the flickering of the display image and the spot generation, reducing the manufacturing cost by eliminating the transparent electrode made of ITO.

To achieve the above object, according to an aspect of the present invention, there is provided a plasma display apparatus, including a front substrate; a plurality of first, second electrodes formed on the front substrate; a rear substrate that is faced with the front substrate; a plurality of third electrodes formed on the rear substrate; and a discharge cell that is disposed in the place where the first, the second electrode intersect with the third electrode, wherein at least one of the plurality of the first and the second electrode is formed with one layer, wherein the thickness of at least one of the plurality of the first and the second electrode ranges from 3 μm to 7 μm.

According to an aspect of the present invention, at least one of the plurality of the first, the second electrode comprises: a line portion formed in the direction intersecting with the third electrode; and a protrusion protruded from the line portion.

The resistance of at least one of the plurality of the first and the second electrode ranges from 50Ω to 65Ω.

The resistance of at least one of the plurality of the first and the second electrode ranges from 40Ω to 90Ω.

The resistance of the electrode is a resistance between the both ends of the electrode positioned in an effective display region of the panel.

The line portion is two or more, and the gap between the adjacent line portion among the two or more line portions ranges 80 μm to 120 μm.

The protrusion forms at least one closed loop.

The plasma display apparatus according to an aspect of the present invention further comprises a front dielectric layer covering the first, the second electrode, wherein at least one of the first and the second electrode is darker than the front dielectric layer.

On the rear substrate, a dielectric layer; a barrier rib partitioning off the discharge cell; and a phosphor layer is formed.

A plasma display apparatus according to another aspect of the present invention comprises a front substrate; a plurality of first, second electrodes formed on the front substrate; a rear substrate that is faced with the front substrate; a plurality of third electrodes formed on the rear substrate; a line portion formed in the direction intersecting with the third electrode; and a protrusion protruded from the line portion, wherein at least one of the plurality of the first and the second electrodes is formed with one layer, wherein the width of the protrusion ranges from 35 μm to 70 μm.

The width of the protrusion ranges from 35 μm to 45 μm.

The protrusion is two or more.

The plasma display apparatus of claim 10, wherein the protrusion forms at least one closed loop.

A plasma display apparatus according to further aspect of the present invention comprises a front substrate; a plurality of first, second electrodes formed on the front substrate; a rear substrate that is faced with the front substrate; a plurality of third electrodes formed on the rear substrate; a line portion formed in the direction intersecting with the third electrode; and a protrusion protruded from the line portion, wherein at least one of the plurality of the first and the second electrodes is formed with one layer, wherein the gap between the protrusion of the first electrode and the protrusion of the second electrode ranges from 15 μm to 165 μm.

The gap between the protrusion of the first electrode and the protrusion of the second electrode ranges from 60 μm to 120 μm.

A plasma display apparatus according to further aspect of the present invention further comprises a front dielectric layer covering the first, the second electrode, wherein at least one of the first and the second electrode is darker than the front dielectric layer.

The protrusion forms at least one closed loop.

A plasma display apparatus according to further aspect of the present invention comprises: a front substrate; a plurality of first, second electrodes formed on the front substrate; a rear substrate that is faced with the front substrate; a plurality of third electrodes formed on the rear substrate; a line portion formed in the direction intersecting with the third electrode; and a protrusion protruded in the direction of barrier rib which is adjacent to the line portion from the line portion, wherein at least one of the plurality of the first and the second electrodes is formed with one layer, wherein the length of the protrusion ranges from 30 μm to 100 μm.

The length of the protrusion ranges from 50 μm to 100 μm.

The gap between the adjacent barrier ribs ranges from 70 μm or less.

BRIEF DESCRIPTION OF THE DRAWINGS

The present invention will be described in detail with reference to the following drawings in which like numerals refer to like elements. The accompany drawings, which are included to provide a further understanding of the present invention and are incorporated in and constitute a part of this specification, illustrate embodiments of the present invention and together with the description serve to explain the principles of the present invention. In the drawings.

DETAILED DESCRIPTION OF THE EMBODIMENTS

Preferred embodiments of the present invention will be described in a more detailed manner with reference to the drawings.

Figure 2A:
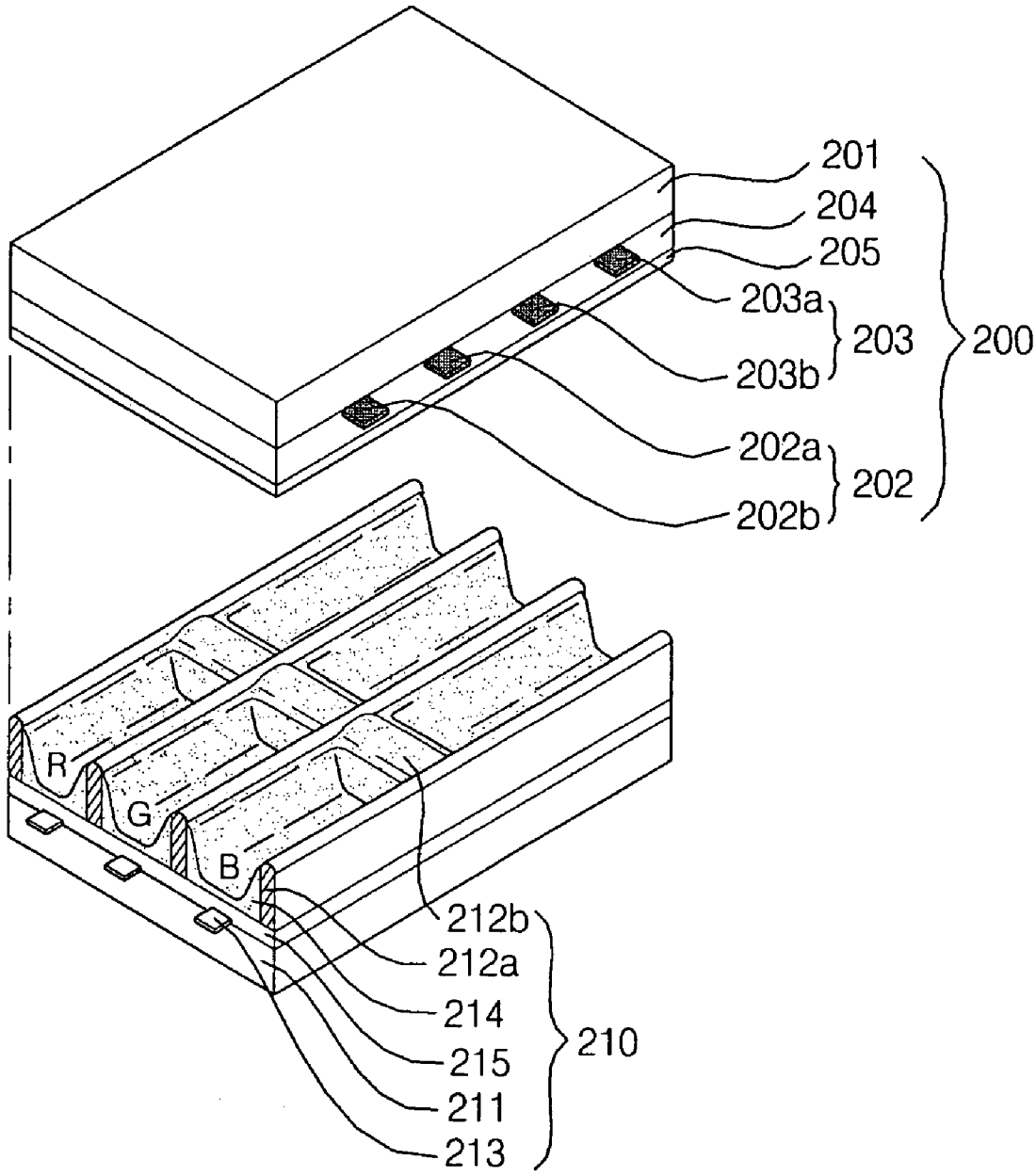
FIG. 2*a* is a drawing showing a first embodiment of a plasma display panel according to the present invention.

Hereinafter, FIG. 2*a* is a drawing showing a first embodiment of a plasma display panel according to the present invention.

Referring to FIG. 2*a*, the plasma display panel includes a front panel 200 and a rear panel 210 coalesced with a predetermined gap.

The plasma display panel includes an address electrode 213, and barrier ribs. The address electrode 213 is formed on the rear substrate 211 in the direction intersecting with the sustain electrode pair 202, 203, while barrier rib 212*a*, 212*b* partitions off a plurality of discharge cells.

The front panel 200 includes a sustain electrode pair 202, 203 which is formed on a front substrate 201 with forming a pair. According to a function, the sustain electrode pair 202, 203 are classified into a scan electrode 202 and a sustain electrode 203. The sustain electrode pair 202, 203 is covered with a front dielectric layer 204 that limits the discharge current and insulates between the electrode pair. A passivation layer 205 is formed on the top of the front dielectric layer 204, thereby, the front dielectric layer 204 is protected from the sputtering of the charged particles generated during the gaseous discharge and the emission efficiency of the secondary electron can be enhanced.

On the rear panel 210, a barrier rib 212 partitioning off a plurality of discharge spaces, that is, a discharge cell is formed on the lower substrate 211. Further, an address electrode 213 is arranged in the direction intersecting with sustain electrode pair 202, 203. A phosphor 214 which is light-emitted by the ultraviolet ray generated during the gaseous discharge time to generate a visible light is coated onto the surface of the barrier rib 212 and the rear dielectric layer 215.

In this way, the inactive gas containing a main gas including Ne, He, or the mixed gas Ne+He, and a small amount of xenon are filled in the discharge cell surrounded by the barrier rib 212*a*, 212*b*.

The pressure of the gas in the panel may range from 350 Torr to 500 Torr so as to enhance the discharge efficiency and to facilitate the panel manufacturing processing.

At this time, the barrier rib 212 is comprised of a column barrier rib 212*a* developed into the direction in parallel with the address electrode 213, and a row barrier rib 212*b* developed into the direction intersecting with the address electrode 213, which divides the discharge cell physically and prevents the ultraviolet ray generated by a discharge and the visible light from being leaked out into the adjacent discharge cell.

Figure 1:
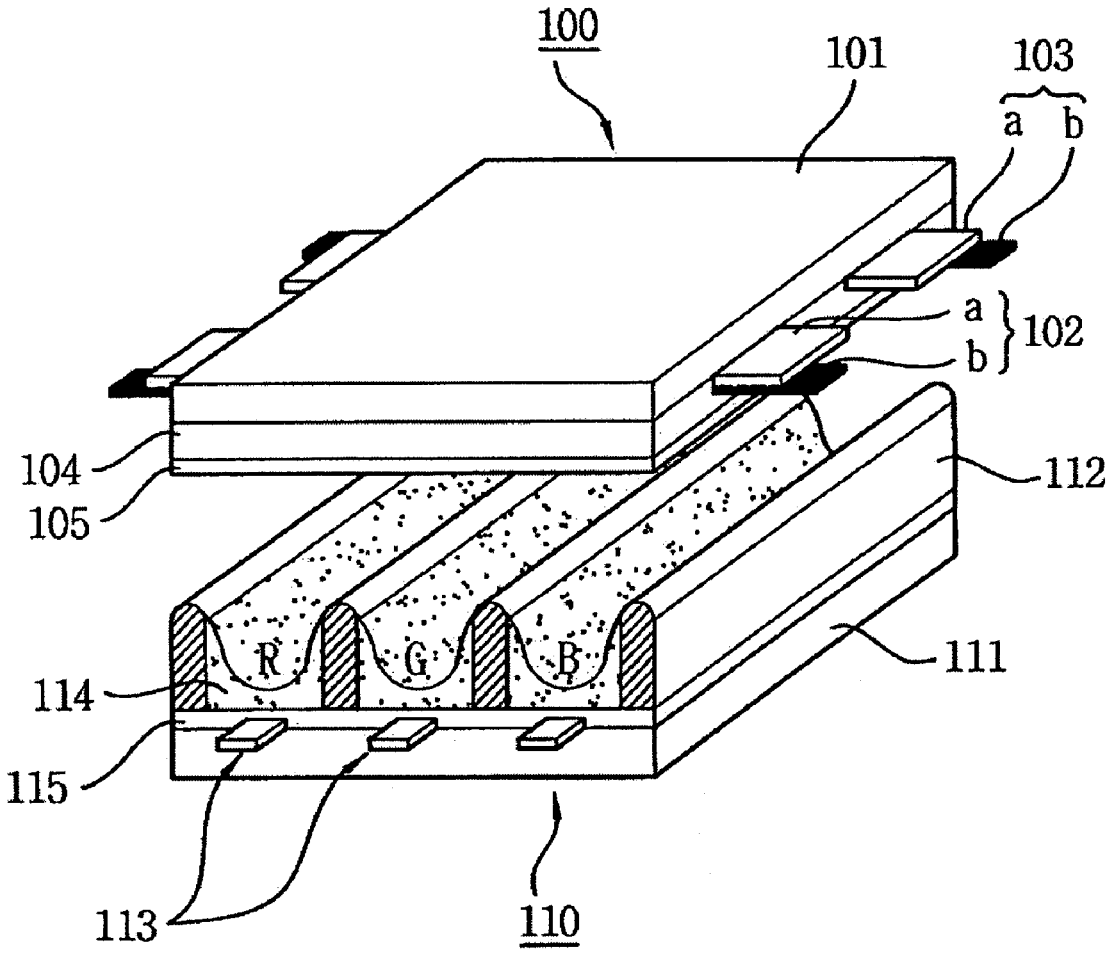
Fig.1 (related art)
FIG. 1 is a drawing showing the structure of a plasma display panel equipped in the plasma display apparatus of the related art.

Further, in the plasma display panel according to an embodiment of the present invention, the sustain electrode pair 202, 203 is made of an opaque metal electrode differently from the sustain electrode pair 102, 103 shown in FIG. 1. That is, ITO which is a conventional transparent electrode material is not used, while the sustain electrode pair 202, 203 is formed by using the conventional material of the bus electrode such as Ag, Cu or Cr. That is, each sustain electrode pair 202, 203 of the plasma display panel according to the embodiment of the present invention does not include the conventional ITO electrode. The sustain electrode pair 202, 203 of the plasma display panel according to the embodiment of the present invention is made of one layer with the sole bus electrode.

For example, it is preferable that the sustain electrode pair 202, 203 according to the embodiment of the present invention is made of silver. It is preferable that the silver Ag has the photosensitivity property. Further, it is preferable that the sustain electrode pair 202, 203 according to the embodiment of the present invention is more gloomy and the permeability of the light is more low than the front dielectric layer 204 formed on the front substrate 201.

It is preferable that the thickness of the electrode lines 202*a* 202*b*, 203*a*, 203*b* range from 3 μm to 7 μm. In case the electrode lines 202*a* 202*b*, 203*a*, 203*b* are formed with a range of such thickness, with obtaining a range of resistance with which the plasma display panel can normally operate and a necessary aperture ratio, the light reflected to the front of the plasma display apparatus can be prevented from the reduction of luminance of an image resulting from the blocking of the electrode.

It is preferable that the resistance of the electrode lines 202*a*, 202*b*, 203*a*, 203*b* ranges from 50Ω to 65Ω, with the thickness as described in the above. Further, it is preferable that the resistance of electrode lines 202*a*, 202*b*, 203*a*, 203*b* ranges from 90Ω to 40 in order that the capacitance of the panel is not increased for obtaining the drive margin of the panel.

It is preferable that the resistance of electrode lines 202*a*, 202*b*, 203*a*, 203*b* is the resistance between the both ends of the electrode adjacent to the pad portion (not shown) connecting the driver circuit (not shown) of the panel to the electrode lines 202*a*, 202*b*, 203*a*, 203*b*, or it can be the resistance of the both ends between the electrodes positioned in the effective display region of the panel.

The thickness, or the width of each R, G, B phosphor layer 214 can be substantially identical or can be different. In case the thickness of each R, G, B phosphor layer 214 is different each other, the thickness of the phosphor layer 214 in G discharge cell or B discharge cell can be bigger than the thickness of the phosphor layer 214 in R discharge cell.

As shown in FIG. 2*a*, it is preferable that the sustain electrodes 202, 203 is formed in one discharge cell with a plurality of electrode lines. That is, it is preferable that the first sustain electrode 202 is formed with two electrode lines 202*a*, 202*b*, while the second sustain electrode 203 is arranged to be symmetrized with the first sustain electrode 202 based on the center of the discharge cell, and formed with two electrode lines 203*a*, 203*b*. It is preferable that the first, and the second sustain electrodes 202, 203 are the scan electrode and the sustain electrode respectively.

In that case, the aperture ratio and the discharge diffusion efficiency are considered according to the use of an opaque sustain electrode pair 202, 203. That is, the electrode line having the narrow width is used in consideration of the aperture ratio, while a plurality of electrode lines are used in consideration of the discharge diffusion efficiency. At this time, it is preferable that the number of electrode lines is determined in consideration of the aperture ratio and the discharge diffusion efficiency and discharge diffusion efficiency at the same time.

In the meantime, though not shown in FIG. 2*a*, each electrode lines 202*a*, 202*b*, 203*a*, 203*b* of does not directly contact the front substrate 201, but can be formed on a predetermined black layer. That is, the black layer is formed between the front substrate 201 and each electrode lines 202*a*, 202*b*, 203*a*, 203*b*, the metachromatism of the front substrate 201 which can be generated when the front substrate 201 and each electrode lines 202*a*, 202*b*, 203*a*, 203*b* directly contact can be improved.

The structure of the panel shown in FIG. 2*a* is just an embodiment of the structure of a plasma display panel according to the present invention. Therefore, the present invention is not restricted to the structure of the plasma display panel shown in FIG. 2. For example, a Black Matrix BM that blocks a light to reduce a reflection by absorbing the external light generated in the outside and to improve the purity and the contrast of the front substrate 201 can be formed on the front substrate 201, while the black matrix is available with both an unitary type and a separation type.

In the meantime, the black matrix can be formed with the black layer simultaneously in the forming process to be physically connected, while they are not physically connected when they are formed in different time point. Further, in case of being physically connected to be formed, the black matrix and the black layer are formed with the same material. However, in case the black matrix and the black layer are separated physically to be formed, they can be made of other material.

Further, the panel structure shown in FIG. 2 shows a close type in which the discharge cell has a closed architecture due to the column barrier rib 212*a* and a row barrier rib 212*b*. However, it is not restricted to such type, but a stripe type that has only the row barrier rib 212*b* or a fish bone structure where a protrusion is formed with a predetermined gap on the column barrier rib 212*a* can be used.

In addition, as to the plasma display panel according to an embodiment of the present invention, various barrier rib structures having various shapes as well as the barrier rib structure shown in FIG. 2 is available.

A differential type barrier rib structure where the height of the column barrier rib 212*a* and the row barrier rib 212*b* are different, a channel type barrier rib structure where a channel which can be used as ventilating passage is formed in at least one of the column barrier rib 212*a* and the row barrier rib 212*b*, and a hollow type barrier rib structure where a hollow is formed in at least one of the column barrier rib 212*a* and the row barrier rib 212*b* can be used.

Here, in the differential barrier rib structure, it is preferable that the height of the row barrier rib 212*b* is higher than the height of the column barrier rib 212*a*. In the channel type barrier rib structure or the hollow type barrier rib structure, it is preferable that a channel or a hollow is formed in the row barrier rib 212*b*.

In the meantime, in the embodiment of the present invention, it is illustrated that the discharge cell R, G and B is arranged in the same line. However, the other shape can be arranged. For example, the arrangement of a delta type where the discharge cell R, G and B is arranged in a triangle form can be used. In addition, the various polygonal shape including a pentagon, a hexagon as well as the square shape can be used for the shape of the discharge cell.

Further, the width of the column barrier rib 212*a* and the width of the row barrier rib 212*b* can be different. The width of the barrier rib can be the width of the upper part or the lower part. In addition, it is preferable that the width of the row barrier rib 212*b* ranges from 1.0 times to 5.0 times of the width of the column barrier rib 212*a*.

In the meantime, the pitch of R, G, B discharge cell of the plasma display panel according to the embodiment of the present invention can be substantially identical. However, the pitch of R, G, B discharge cell can be different so as to fit the color temperature in R, G, B discharge cell. In this case, the pitch of R, G, B discharge cell can be different discharge cell-by-cell. However, only the pitch of the discharge cell which expresses one color of R, G, B discharge cell can be different. For example, the pitch of R discharge cell is most small, and the pitch of G, B discharge cell can be bigger than the pitch of R discharge cell.

Further, as to the address electrode formed in the rear substrate 211, the width or the thickness can be substantially uniform. However, the width or the thickness of the inside of the discharge cell can be different from the width or the thickness of the outside of the discharge cell. For example, the width or the thickness of the inside of the discharge cell can be broader or thicker than the width or the thickness of the outside of the discharge cell.

It is preferable that the material of the barrier rib 212*a*, 212*b* is not used with a lead Pb, or with a little bit lead such as 0.1 wt % of total weight or 1000 Parts Per Million PPM or less.

Here, in the case that the whole content of the lead is 1000 PPM or less, the content of the lead is 1000 PPM or less on the basis of the weight of plasma display panel.

On the other hand, the content of the lead in a specific component of the plasma display panel can be 1000 PPM or less. For example, the lead of the barrier rib, the content of the lead in the electrode or the lead of the dielectric layer can be 1000 PPM or on the basis of the weight of each component such as the barrier rib, the dielectric layer, and the electrode.

Furthermore, the content of the lead of all the compositional elements such as the barrier rib, the dielectric layer, the electrode and the phosphor layer can be 1000 PPM or less on the basis of the weight of the plasma display panel. In this way, the reason of setting the whole content of the lead with 1000 PPM or less is that the lead influences the bad effect on the human body.

Figure 2B:
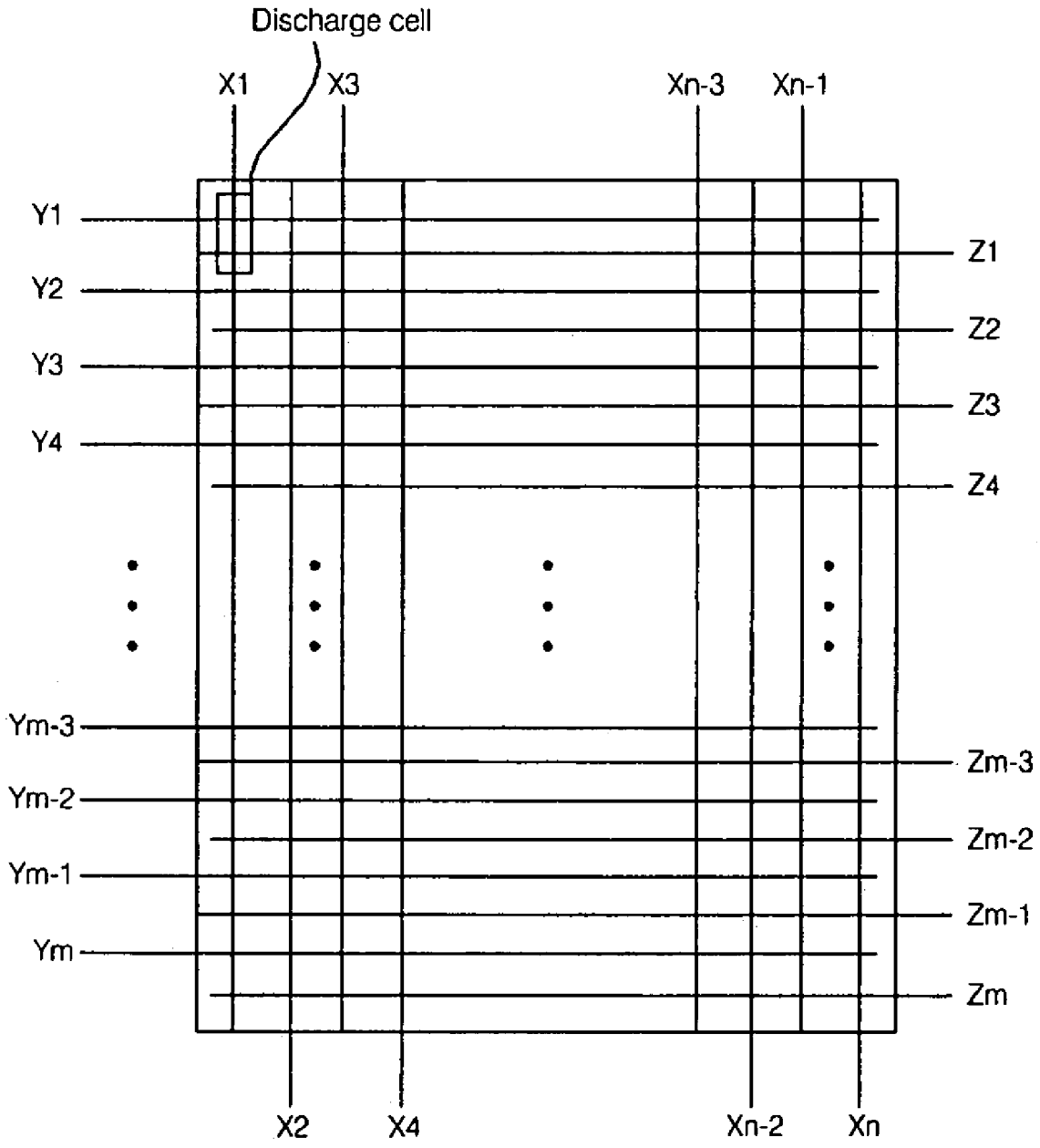
FIG. 2*b* is a drawing showing an embodiment of the electrode arrangement of a plasma display panel

FIG. 2*b* is a drawing showing an embodiment of the electrode arrangement of a plasma display panel.

As shown in FIG. 2*b*, it is preferable that a plurality of discharge cells forming a plasma display panel are arranged as a matrix type. The plurality of discharge cells are positioned in the intersection of the scan electrode lines Y1 to Ym, the sustain electrode lines Z1 to Zm and the address electrode lines X1 to Xn. The scan electrode Y1 to Ym is sequentially drived, while the sustain electrode Z1 to Zm is commonly drived. The address electrode lines X1 to Xn is divided into even number lines and odd number lines to be drived.

The electrode arrangement shown in FIG. 2*b* is just an embodiment of the electrode arrangement of the plasma display panel according to the present invention. Therefore, the present invention is not restricted to the electrode arrangement of the plasma display panel and the driving method shown in FIG. 2*b*.

For example, the dual scan mode or the double scan mode in which two scan electrode lines in the scan electrode lines Y1 to Ym are drived simultaneously can be available. Here, the dual scan method is a mode in which the plasma display panel is divided into two regions with an upper region and a lower region, while one scan electrode line which belongs to the upper region and the lower region respectively is drived simultaneously. On the other hand, the double scan mode is a mode in which two scan electrode lines which are sequentially arranged are drived simultaneously.

The first embodiment of the plasma display panel structure according to the present invention shown in FIG. 22 will be described in detail with FIG. 3.

Figure 3:
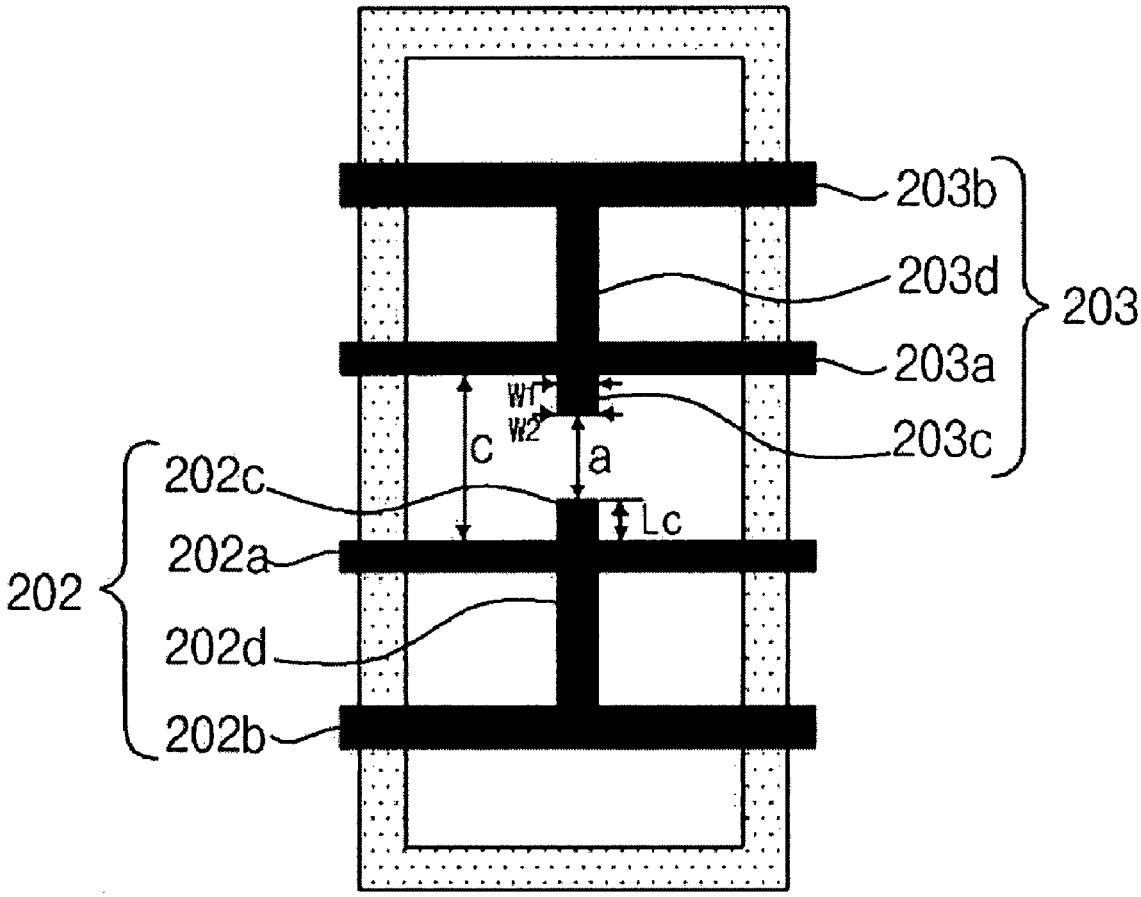
FIG. 3 is a drawing showing a first embodiment of the electrode structure of a plasma display panel according to the present invention.

FIG. 3 is a cross-sectional view showing a first embodiment of the electrode structure of a plasma display panel according to the present invention, in which only the arrangement structure of the sustain electrode pair 202, 203 formed in a discharge cell in the plasma display panel shown in FIG. 2*a* is briefly shown.

Figure 4:
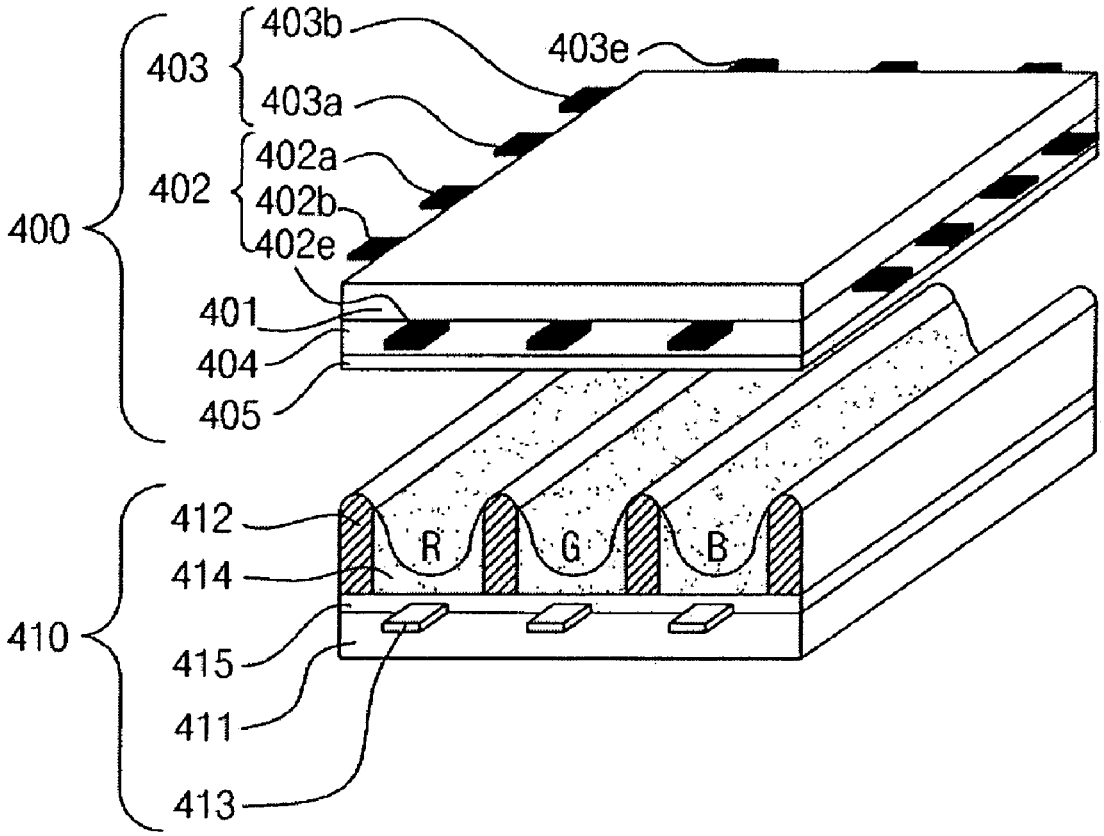
FIG. 4 is a drawing showing a second embodiment of a plasma display panel according to the present invention.

As shown in FIG. 3, the sustain electrodes 202, 203 according to a first embodiment of the present invention are formed as a pair to be symmetrical on the substrate based on the center of the discharge cell. Each sustain electrode is comprised of a line portion including at least two electrode lines 202*a*, 202*b*, 203*a*, 203*b* crossing the discharge cell, and a protrusion including at least one projecting electrode 202*c*, 203*c* which is protruded to the center of the discharge cell in the discharge cell and connected to the electrode line 202*a*, 203*a* which is the closest to the center of the discharge cell. Further, it is preferable that, as shown in FIG. 4, each sustain electrode 202, 203 further includes one bridge electrode 202*d*, 203*d* connecting the two electrode lines 202*a* and 202*b*, 203*a* and 203*b*.

The electrode lines 202*a*, 202*b*, 203*a*, 203*b* cross the discharge cell, and extending to the direction of the plasma display panel. The electrode line according to the first embodiment of the present invention narrowly forms a width so as to improve the aperture ratio. Further, it is preferable that a plurality of electrode lines 202*a*, 202*b*, 203*a*, 203*b* are used so as to improve the discharge diffusion efficiency while the number of electrode lines are determined in consideration of the aperture ratio.

It is preferable that projecting electrodes 202*c*, 203*c* are connected to electrode lines 202*a*, 203*a* which are closest to the center of the discharge cell in one discharge cell, and protruding to the center of the discharge cell. Projecting electrodes 202*c*, 203*c* lower the firing voltage in driving the plasma display panel.

The first embodiment of the present invention includes projecting electrodes 202*c*, 203*c* connected to each electrode line 202*a*, 203*a* since the firing voltage increases due to the distance c of the electrode line 202*a*, 203*a*. The firing voltage of the plasma display panel can be lowered, since a discharge can be generated in a low firing voltage between the projecting electrodes 202*c*, 203*c* which are formed closely. Here, the firing voltage is a voltage level where a discharge is initiated when a pulse is supplied to at least one electrode.

As to the projecting electrodes 202*c*, 203*c*, the size is very small. Therefore, due to the tolerance of the manufacturing process, the width W1 of the portion connected to electrode lines 202*a*, 203*a* of projecting electrodes 202*c*, 203*c* can be broader than the width W2 of the end portion of the projecting electrode, while, if necessary, the width W2 can be broader than the width W1.

It is preferable that the gap between two adjacent electrode lines that form a sustain electrode pair 203, 202 respectively, that is, the gap between 203*a* and 203*b* or the gap between 202*a* and 202*b*, ranges from 80 μm to 120 μm. In case the gap between two adjacent electrode lines has such value, the aperture ratio of the plasma display panel can be obtained sufficiently, the luminance of the display image can be increased, and the discharge diffusion efficiency in a discharge space can be increased.

It is preferable that the width W1 of projecting electrodes 202*c*, 203*c* ranges from 30 μm to 70 μm. In case the width W1 of projecting electrodes 202*c*, 203*c* has such value, the light reflected to the front of the plasma display apparatus can be prevented from the reduction of luminance of an image resulting from the blocking of the electrode with a small aperture ratio of the plasma display panel.

Further, when the width W1 of projecting electrodes 202*c*, 203*c* ranges from 35 μm to 45 μm, the luminance of the display image can be improved, and the discharge efficiency can be optimized. It is preferable that the gap a between the projecting electrodes 202*c*, 203*c* ranges from 15 μm to 165 μm. In case the gap a between the projecting electrodes 202*c*, 203*c* has such a value, the gap a, the proper firing voltage for the plasma display panel drive can be obtained.

In addition, in order to prevent the discharge between the projecting electrodes 202*c*, 203*c* from being generated over the critical value and shortening the lifetime of the electrode, the gap a between the projecting electrodes 202*c*, 203*c* can be 15 μm to 165 μm.

The bridge electrode 202*d*, 203*d* connects two electrode lines 202*a* and 202*b*, 203*a* and 203*b* which form the sustain electrode 202, 203 respectively. The bridge electrode 202*d*, 203*d* helps the discharge generated through projecting electrodes 202*c*, 203*c* to be easily diffused to the electrode lines 202*b*, 203*b* which are far from the center of the discharge cell.

As to the electrode structure according to the first embodiment of the present invention, the number of electrode lines can be suggested like that, thereby, the aperture ratio can be improved. Further, the firing voltage can be lowered by forming projecting electrodes 202*c*, 203*c*. Further, the discharge diffusion efficiency is increased with electrode lines 202*b*, 203*b* and bridge electrodes 202*d*, 203*d* when electrode lines 202*b*, 203*b* are far from the center of the discharge cell. The luminous efficiency of the plasma display panel, as a whole, can be improved. That is, the brightness of the present invention is equal to the brightness of the conventional plasma display panel or brighter than the brightness of the conventional plasma display panel. Therefore, it is possible not to use an ITO transparent electrode.

FIG. 4 is a perspective drawing showing a second embodiment of a plasma display panel according to the present invention.

As shown in FIG. 4, the second embodiment of the plasma display panel according to the present invention includes a front panel 400 and a rear panel 410 which are coalesced each other with a predetermined gap, a barrier rib 412. The address electrode 413 is formed in the rear panel 410 in the direction intersecting with a sustain electrode pair 402, 403, while the barrier rib 412 partitions off a plurality of discharge cells. Here, the same description of the content described in the first embodiment among the features of the present invention of the plasma display panel according to the second embodiment of the present invention will be omitted.

It is preferable that the sustain electrode pair 402, 403 according to the second embodiment of the present invention are made of only an opaque metal electrode. Accordingly, the manufacturing cost of the plasma display panel can be lowered. That is, it is preferable that each sustain electrode pair 402, 403 of the plasma display panel according to the present invention does not include the conventional ITO electrode, but made of one layer with the sole bus electrode.

For example, it is preferable that each sustain electrode pair 402, 203 according to the embodiment of the present invention is made of silver. It is preferable that the silver has a photosensitivity characteristic. Further, as to the sustain electrode pair 402, 403 according to the embodiment of the present invention, it is preferable that the color of which is more dark than that of the front dielectric layer 404 formed in the front substrate 401, and the permeability of the light is more low.

FIG. 4 shows the unit discharge cell R, G, B. Considering the aperture ratio and the discharge diffusion efficiency, the sustain electrode 402, 403 is formed in one discharge cell with a plurality of electrode lines. Further, in the second embodiment of the present invention, provided is the second projecting electrode 402*e*, 403*e* extended to the opposite direction of the center of the discharge cell, such that the discharge efficiency can be improved than the first embodiment of the present invention.

The structure illustrated in FIG. 4 is just an embodiment of the structure of the plasma panel according to the present invention. Therefore, the present invention is not restricted to the plasma display panel structure illustrated in FIG. 4.

The detailed description on the structure of the sustain electrode pair 402, 403 according to the second embodiment of the present invention shown in FIG. 4 will be described in FIG. 5*a* to FIG. 7.

Figure 5A:
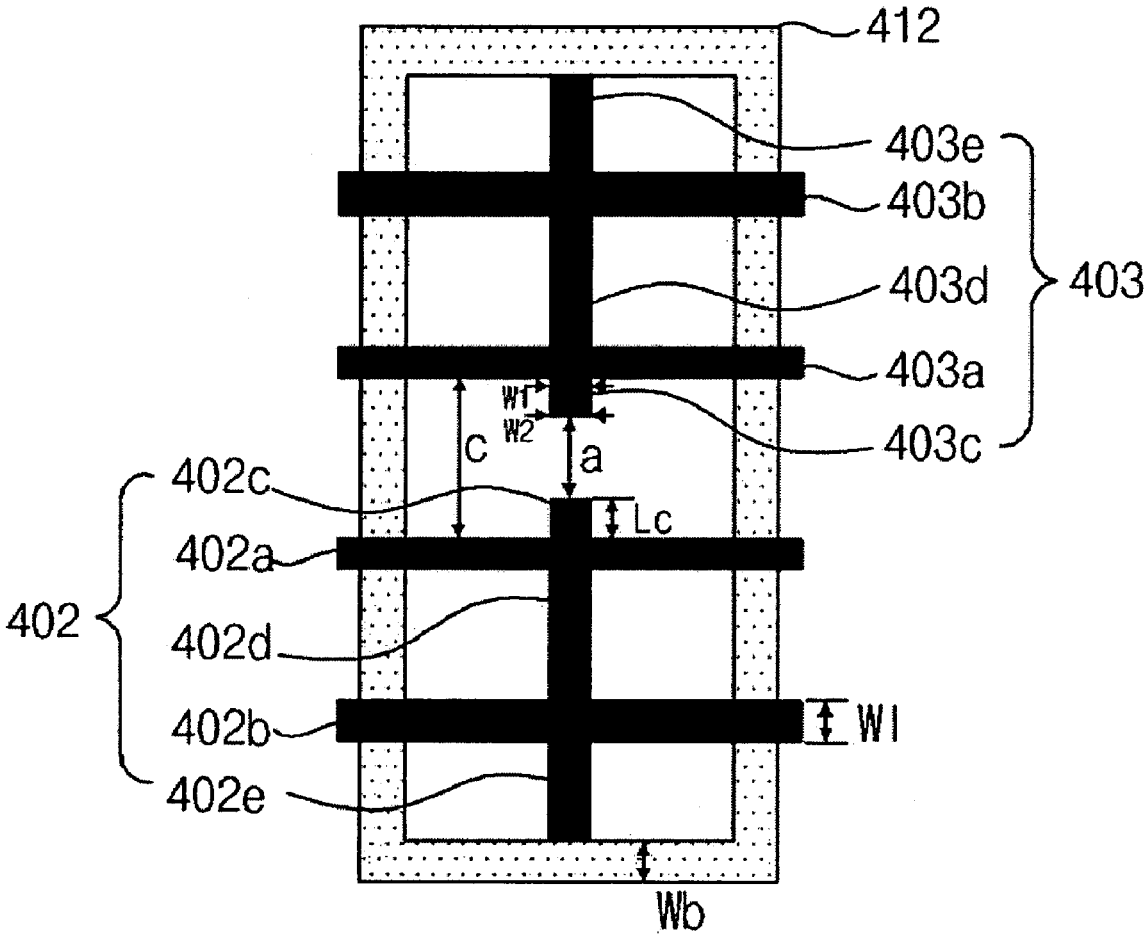
FIG. 5*a* to FIG. 5*b* is a drawing showing a second embodiment of the electrode structure of a plasma display panel according to the present invention.

FIG. 5*a* is a cross-sectional view showing a second embodiment of the electrode structure of a plasma display panel according to the present invention, briefly showing only the layout structure of the sustain electrode pair 402, 403 formed in one discharge cell in the plasma display panel shown in FIG. 4.

As shown in FIG. 5*a*, each sustain electrode 402, 403 is comprised of at least two electrode lines 402*a*, 402*b*, 403*a*, 403*b* crossing the discharge cell, a first projecting electrode 402*c*, 403*c* which is protruded to the center of the discharge cell in the discharge cell and connected to the electrode line 402*a*, 403*a* which is the closest to the center of the discharge cell, a bridge electrode 402*d*, 403*d* connecting the two electrode lines 402*a* and 402*b*, 403*a* and 403*b*, and a second projecting electrode 402*e*, 403*e* which is protruded to the opposite direction of the center of the discharge cell in the discharge cell and connected to the electrode line 402*b*, 403*b* which is most far from the center of the discharge cell.

The electrode lines 402*a*, 402*b*, 403*a*, 403*b* cross the discharge cell, and extending to the direction of the plasma display panel. It is preferable that the electrode line according to the second embodiment of the present invention narrowly forms a width so as to improve the aperture ratio. Preferably, the width of electrode line ranges from 20 μm to 70 μm to improve the aperture ratio and easily generate a discharge.

As shown in FIG. 5*a*, the electrode line 402*a*, 403*a* which is close to the center of the discharge cell is connected to the first projecting electrode 402*c*, 403*c*, forming a path where a discharge diffusion is initiated with the beginning of the discharge. The electrode line 402*b*, 403*b* which is far from the center of the discharge cell is connected to the second projecting electrode 402*e*, 403*e*. The electrode line 402*b*, 403*b* which is far from the center of the discharge cell plays the role of diffusing a discharge to the peripheral of the discharge cell.

The first projecting electrode 402*c*, 403*c* is connected to the electrode line 402*a*, 403*a* which is close to the center of the discharge cell in one discharge cell, and protruding to the center of the discharge cell. Preferably, the first projecting electrode 402*c*, 403*c* is formed in the center of the electrode line 402*a*, 403*a*. The first projecting electrode 402*c*, 403*c* can effectively lower the firing voltage of the plasma display panel with forming in the center of the electrode line 402*a*, 403*a*.

It is preferable that the width W1 of the projecting electrode 402*c*, 403*c* ranges from 35 μm to 45 μm, while the gap between the projecting electrodes 402*c*, 403*c* ranges from 15 μm to 165 μm. The critical meaning of the upper limit value and the lower limit value of the width and the gap of the projecting electrode 402*c*, 403*c* will be omitted since it is identical with the description illustrated in FIG. 3.

The bridge electrodes 402*d*, 403*d* connect two electrode lines 402*a* and 402*b*, 403*a* and 403*b* forming the sustain electrode 402, 403 respectively. The bridge electrode 402*d*, 403*d* helps the generated discharge to be easily diffused to the center of the discharge cell and the remote electrode line 402*b*, 403*b* through the projecting electrode. Here, bridge electrode 402*d*, 403*d* is positioned in the discharge cell, however, if necessary, it can be formed on the barrier rib 412 partitioning off the discharge cell.

Accordingly, in the second embodiment of the electrode structure of the plasma display panel according to the present invention, a discharge can be diffused to the space between the electrode line 402*b*, 403*b* and the barrier rib 412. Therefore, the luminous efficiency of the plasma display panel can be improved by increasing the discharge diffusion efficiency.

The second projecting electrodes 402*e*, 403*e* are connected to the electrode line 402*b*, 403*b* which is far from the center of the discharge cell, and protruding to the opposite direction of the center of the discharge cell. It is preferable that the length of the second projecting electrode 402*e*, 403*e* ranges from 30 μm to 100 μm.

Thus, a discharge can be effectively diffused to the discharge space which is far from the center of the discharge cell. To maintained the aperture ratio of the panel with 25% to 45%, thereby, at the same time, to improve the luminance of the display image, the length of the second projecting electrode 402*e*, 403*e* may range from 50 μm to 100 μm.

As shown in FIG. 5*a*, the second projecting electrode 402*e*, 403*e* can be extended to the barrier rib 412 partitioning off the discharge cell. In addition, if the aperture ratio can be fully compensated in the other part, the second projecting electrode 402*e*, 403*e* can be partly extend on the barrier rib 412 so as to much more improve the discharge diffusion efficiency.

However, in case the second projecting electrode 402*e*, 403*e* is not extended to the barrier rib 412, it is preferable that the gap between the second projecting electrode 402*e*, 403*e* and the barrier rib 412 which is adjacent to the second projecting electrode 402*e*, 403*e* is 70 μm or less.

When the gap between the second projecting electrode 402*e*, 403*e* and the barrier rib 412 is 70 μm or less, a discharge can be diffused effectively to the discharge space which is far from the center of the discharge cell.

It is preferable that, in the second embodiment of the present invention, the second projecting electrode 402*e*, 403*e* is formed in the center of electrode line 402*b*, 403*b* to evenly diffuse a discharge over the peripheral of the discharge cell.

In the meantime, in the second embodiment of the present invention, it is preferable that the width Wb of the barrier rib positioned in the direction to which the second projecting electrode 402*e*, 403*e* is extended among the barrier ribs partitioning off the discharge cell is 200 μm or less.

In addition, it is preferable that a black matrix (not shown) for absorbing the external light to obtain the bright room contrast and preventing the emitted discharge light from being diffused throughout the neighboring discharge cell to display is formed on the barrier rib 412.

The width of the barrier rib 412 is suggested to be 200 μm or less, thereby, the region of the discharge cell is increased. Accordingly, the luminous efficiency can be increased, and the reduction of the aperture ratio due to the second projecting electrode can be compensated. Preferably, the width Wb of the barrier rib positioned in the direction to which the second projecting electrode is extended ranges from 90 μm to 100 μm to obtain the optimum luminous efficiency.

It is preferable that the aperture ratio of the plasma display panel according to the present invention ranges from 25% to 45% so as to improve the luminance of the display image and the contrast, and to obtain the resistance value of the electrode for obtaining the drive margin of the drive panel.

It is preferable that the aperture ratio of the panel is an aperture ratio on the basis of the effective display region of a panel, that is, the region where the discharge cells which affect on the display image of the panel among the discharge cells of the panel is positioned.

Figure 5B:
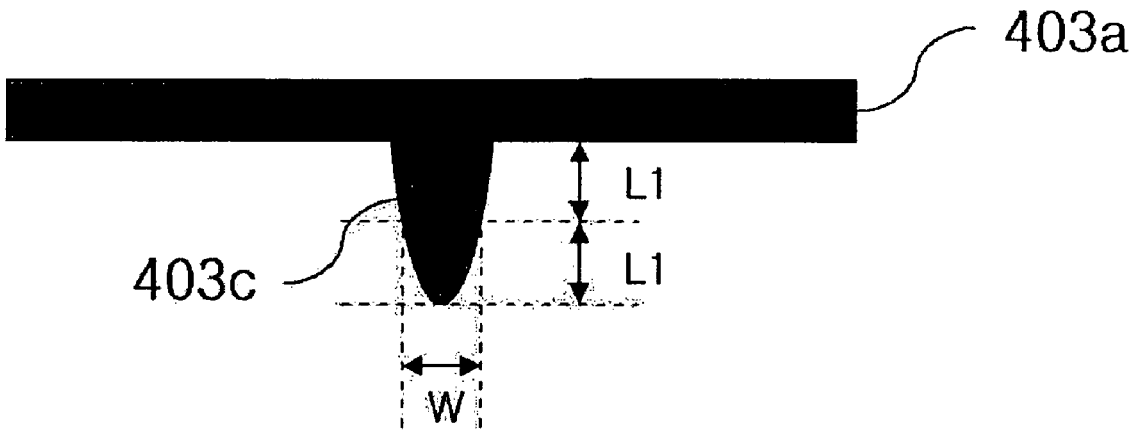

Referring to FIG. 5*b*, the protrusion 403*c* can include a curved portion having a curvature. As shown in FIG. 5*b*, in case the protrusion 403*c* is formed with a curve shape, the manufacturing process of the electrode can be more facilitated. In addition, such shape can prevent the wall charges from being excessively concentrated on a specific location in driving the panel. Accordingly, the discharge characteristic is stabilized, and the driving stability can be improved.

As shown in FIG. 5*b*, in case the protrusion 403*c* is formed with a curve shape, it is preferable that the width W of the protrusion 403*c* is defined as the width of the center portion of the protrusion 403*c*. In addition, the portion in which the bridge electrode 402*d*, 403*d* and the electrode line 402*a*, 403*a* are connected has a curvature like the protrusion 403*c* shown in FIG. 5*b*.

Figure 6:
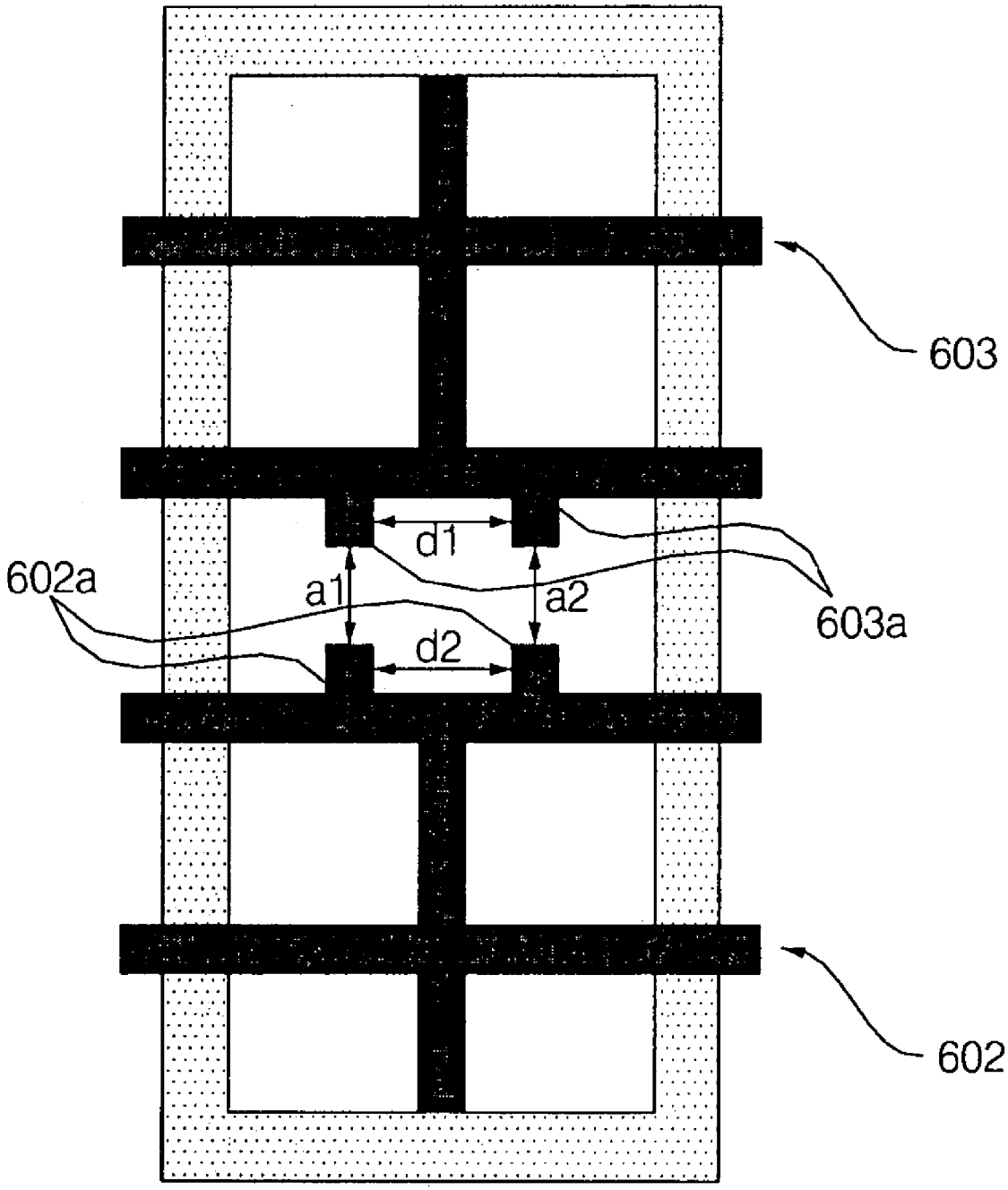
FIG. 6 is a drawing showing a third embodiment of the electrode structure of a plasma display panel according to the present invention.

FIG. 6 is a cross-sectional view showing a third embodiment of the electrode structure of a plasma display panel according to the present invention. The same description described in FIG. 5*a* to FIG. 5*b* among the electrode structure shown in FIG. 6 will be omitted.

As shown in FIG. 6, in the third embodiment of the electrode structure according to the present invention, two first projecting electrodes 602*a*, 603*a* are formed in the sustain electrode 602, 603 respectively. The first projecting electrodes 602*a*, 603*a* are connected to the electrode line which is close to the center of the discharge cell, and protruding to the direction of the center of the discharge cell. Preferably, each first projecting electrodes 602*a*, 603*a* is symmetrized based on the center of the electrode line to be formed.

It is preferable that the width of the first projecting electrodes 602*a*, 603*a* ranges from 35 μm to 45 μm. The critical meaning of the upper limit value and the lower limit value of the width of the projecting electrodes will be omitted since it is identical with the description illustrated in FIG. 3.

It is preferable that the gap d1, d2 of the first projecting electrodes protruded from one electrode line ranges from 50 μm to 100 μm in case the plasma display panel has the size of 42 inch with the resolution of VGA. In case the plasma display panel has the size of 42 inch with the resolution of XGA, it is preferable that the gap d1, d2 of the first projecting electrode ranges from 30 μm to 80 μm. In case the plasma display panel has the size of 50 inch with the resolution of XGA, it is preferable that the gap d1, d2 of the first projecting electrode ranges from 40 μm to 90 μm.

When the gap d1, d2 of the first projecting electrode has such range, the aperture ratio capable of implementing the luminance of the image required for the display device can be obtained. Also, the power used up in displaying can be prevented from being increased over the threshold level, when the power is increased as the reactive power due to the first projecting electrode which is so close to the barrier rib is increased.

Two first projecting electrodes 602*a*, 603*a* are formed on the sustain electrode 602, 603 such that the electrode region in the center of the discharge cell is increased. Accordingly, before a discharge is generated, the space charge is very much formed in the discharge cell, thereby, the firing voltage is more decreased, and the discharge rate is increased. Additionally, after the discharge is generated, the amount of wall charges are increased such that the luminance rises, and the discharge is uniformly diffused throughout the whole discharge cell.

It is preferable that the gap a1, a2 of the first projecting electrodes 602*c*, 603*c*, that is, the gap of two projecting electrodes in the direction intersecting with the electrode line 602, 603 ranges from 15 μm to 165 μm. The critical meaning of the upper limit value and the lower limit value of the gap of the projecting electrodes will be omitted since it is identical with the description illustrated in FIG. 3.

Figure 7:
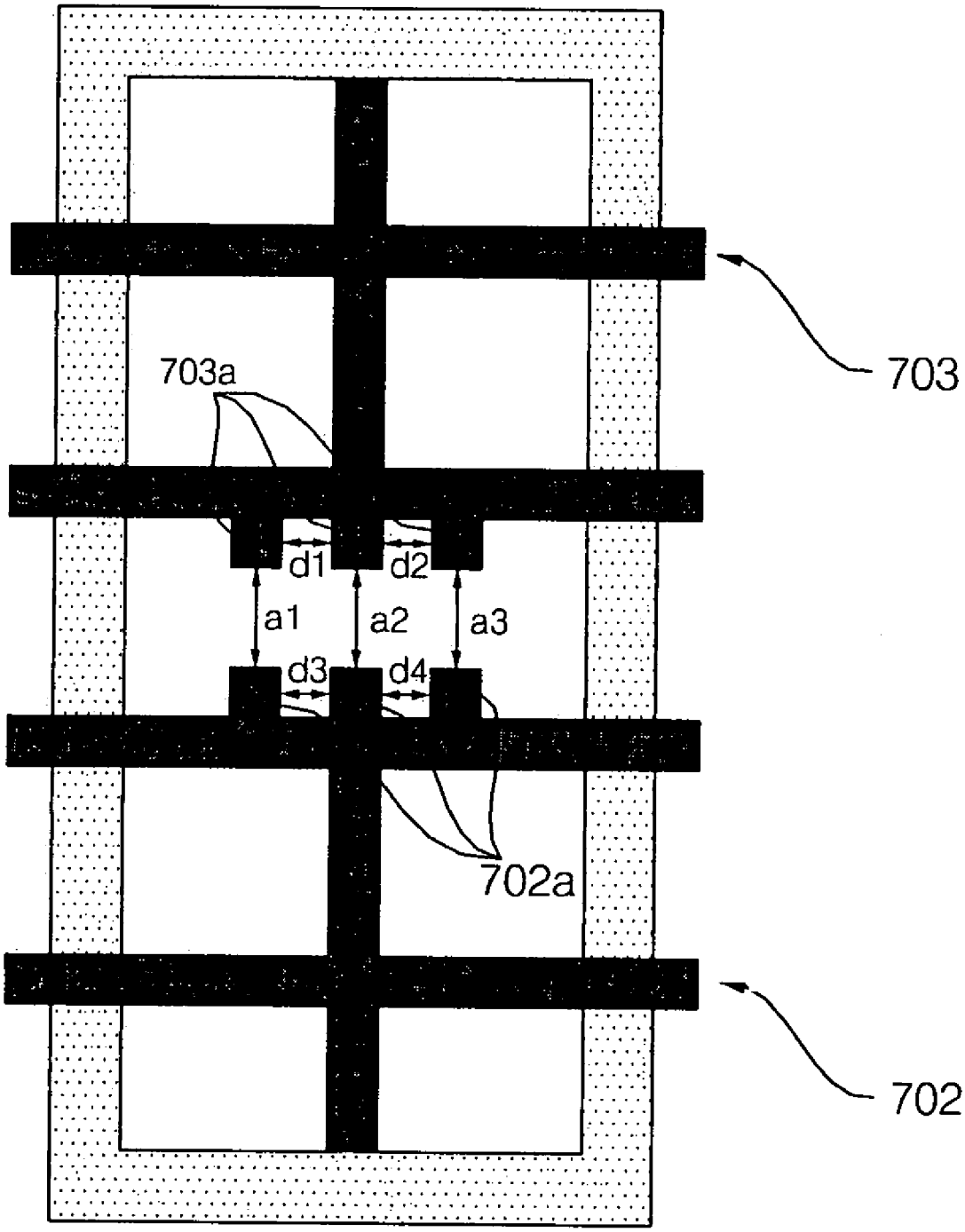
FIG. 7 is a drawing showing a fourth embodiment of the electrode structure of a plasma display panel according to the present invention.

FIG. 7 is a cross-sectional view showing a fourth embodiment of the electrode structure of a plasma display panel according to the present invention. The same description described in FIG. 5, FIG. 6 among the electrode structure shown in FIG. 7 will be omitted.

As shown in FIG. 7, in the fourth embodiment of the electrode structure according to the present invention, three first projecting electrodes 702*a*, 703*a* are formed in the sustain electrode 702, 703 respectively.

The first projecting electrodes 702*a*, 703*a* are connected to the electrode line which is close to the center of the discharge cell, and protruding to the direction of the center of the discharge cell. Preferably, one of first projecting electrodes is formed in the center of the discharge cell, and the other, two electrodes, are symmetrized based on the center of the electrode line to be formed.

Three first projecting electrodes 702*a* 703*a* are formed on the sustain electrode 702, 703 respectively. Thus, the firing voltage is much more decreased than FIG. 5 and FIG. 6, and the discharge rate is much more increased. Additionally, after a discharge is generated, the luminance is much more increased, and the discharge is more uniformly diffused throughout the whole discharge cell.

As described in the above, by increasing the number of the first projecting electrode, the electrode region in the center of the discharge cell increases such that the firing voltage is decreased and a luminance increases. On the other hand, it should be considered that the brightest discharge light is emitted while the strongest discharge occurs in the center of the discharge cell. That is, by blocking the light emitted in the center of the discharge cell as the number of the first projecting electrode increases, the emitted light remarkedly reduces. Furthermore, additionally considering the firing voltage and the luminous efficiency at the same time, the most optimal number is selected to design the structure of the sustain electrode.

It is preferable that the width of the first projecting electrodes 702*a*, 703*a* ranges from 35 μm to 45 μm, while the gap a1, a2, a3 of the first projecting electrodes 702*c*, 703*c* ranges from 15 μm to 165 μm. The critical meaning of the upper limit value and the lower limit value of the gap and the width of the projecting electrodes will be omitted since it is identical with the description illustrated in FIG. 3.

Figure 8:
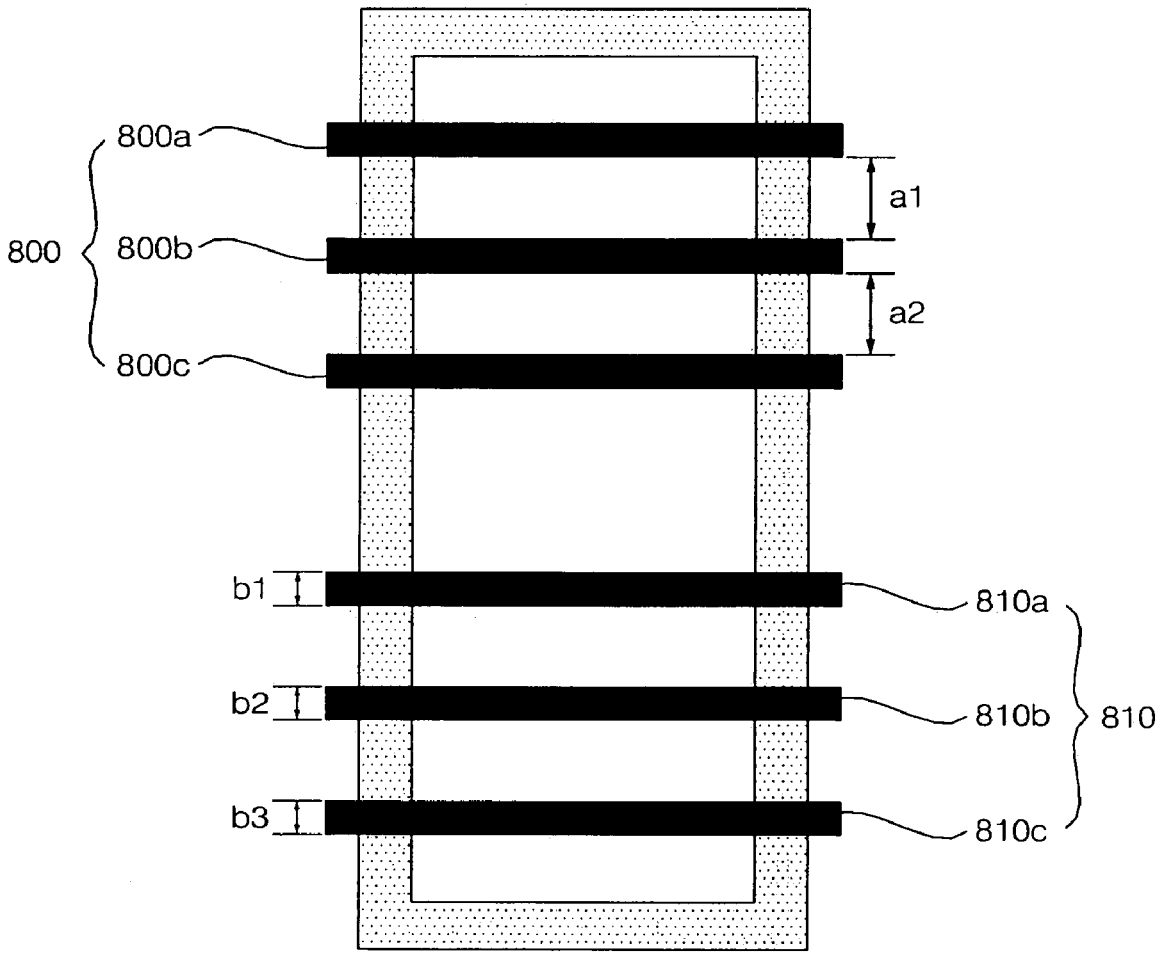
FIG. 8 is a drawing showing a fifth embodiment of the electrode structure of a plasma display panel according to the present invention.

FIG. 8 is a cross-sectional view showing a fifth embodiment of the electrode structure of a plasma display panel according to the present invention.

Each sustain electrode 800, 810 includes three electrode lines 800*a*, 800*b*, 800*c*, 810*a*, 810*b*, 810*c* crossing the discharge cell. The electrode lines are extended to one direction of the plasma display panel with crossing the discharge cell. The width of the electrode lines is narrowly formed to increase the aperture ratio. Preferably, the width of the electrode lines ranges from 20 μm to 70 μm such that the aperture ratio can be improved and a discharge can be smoothly occurred.

It is preferable that the thickness of the electrode lines 800*a*, 800*b*, 800*c*, 810*a*, 810*b*, 810*c* of the sustain electrode pair ranges from 3 μm to 7 μm. The gap a1, a2 of the electrode lines of three electrode lines forming the sustain electrode can be identical or different, while the width b1, b2, b3 of the electrode lines can be identical or different.

The critical meaning of the upper limit value and the lower limit value of the thickness of the electrode lines will be omitted since it is identical with the description illustrated in FIG. 2*a*.

Figure 9:
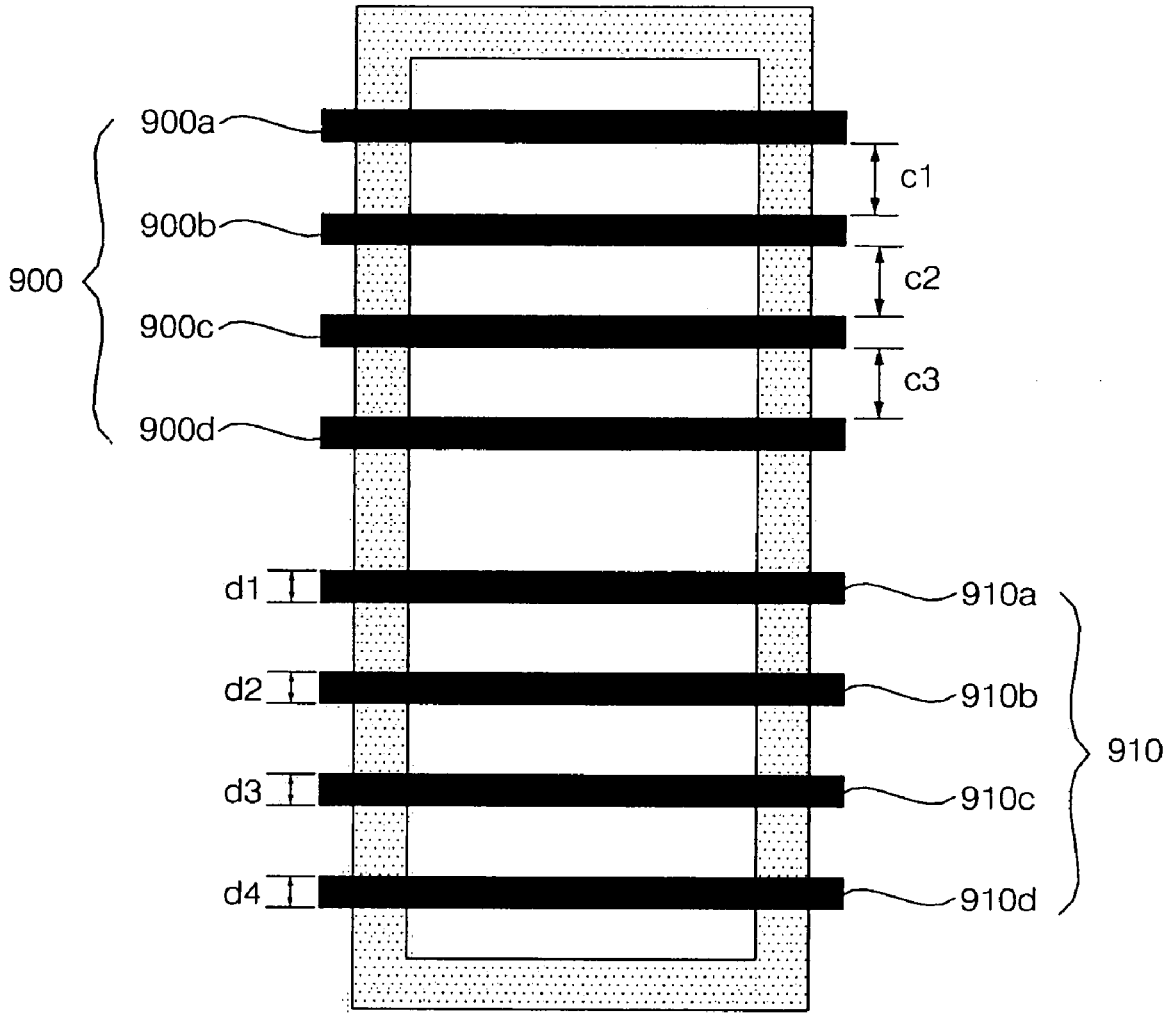
FIG. 9 is a drawing showing a sixth embodiment of the electrode structure of a plasma display panel according to the present invention.

FIG. 9 is a cross-sectional view showing a sixth embodiment of the electrode structure of a plasma display panel according to the present invention.

Each sustain electrode 900, 910 includes four electrode lines 900*a*, 900*b*, 900*c*, 900*d*, 910*a*, 910*b*, 910*c*, 910*d* crossing the discharge cell. The electrode lines are extended to one direction of the plasma display panel with crossing the discharge cell. The width of the electrode lines is narrowly formed to increase the aperture ratio. Preferably, the width of the electrode lines ranges from 20 μm to 70 μm such that the aperture ratio can be improved and a discharge can be smoothly occurred.

It is preferable that the thickness of the electrode lines 900*a*, 900*b*, 900*c*, 900*d*, 910*a*, 910*b*, 910*c*, 910*d* of the sustain electrode pair ranges from 3 μm to 7 μm. The critical meaning of the upper limit value and the lower limit value of the thickness of the electrode lines will be omitted since it is identical with the description illustrated in FIG. 2*a*.

The gap c1, c2, c3 of the electrode lines of four electrode lines forming the sustain electrode can be identical or different, while the width d1, d2, d3, d4 of the electrode lines can be identical or different.

Figure 10:
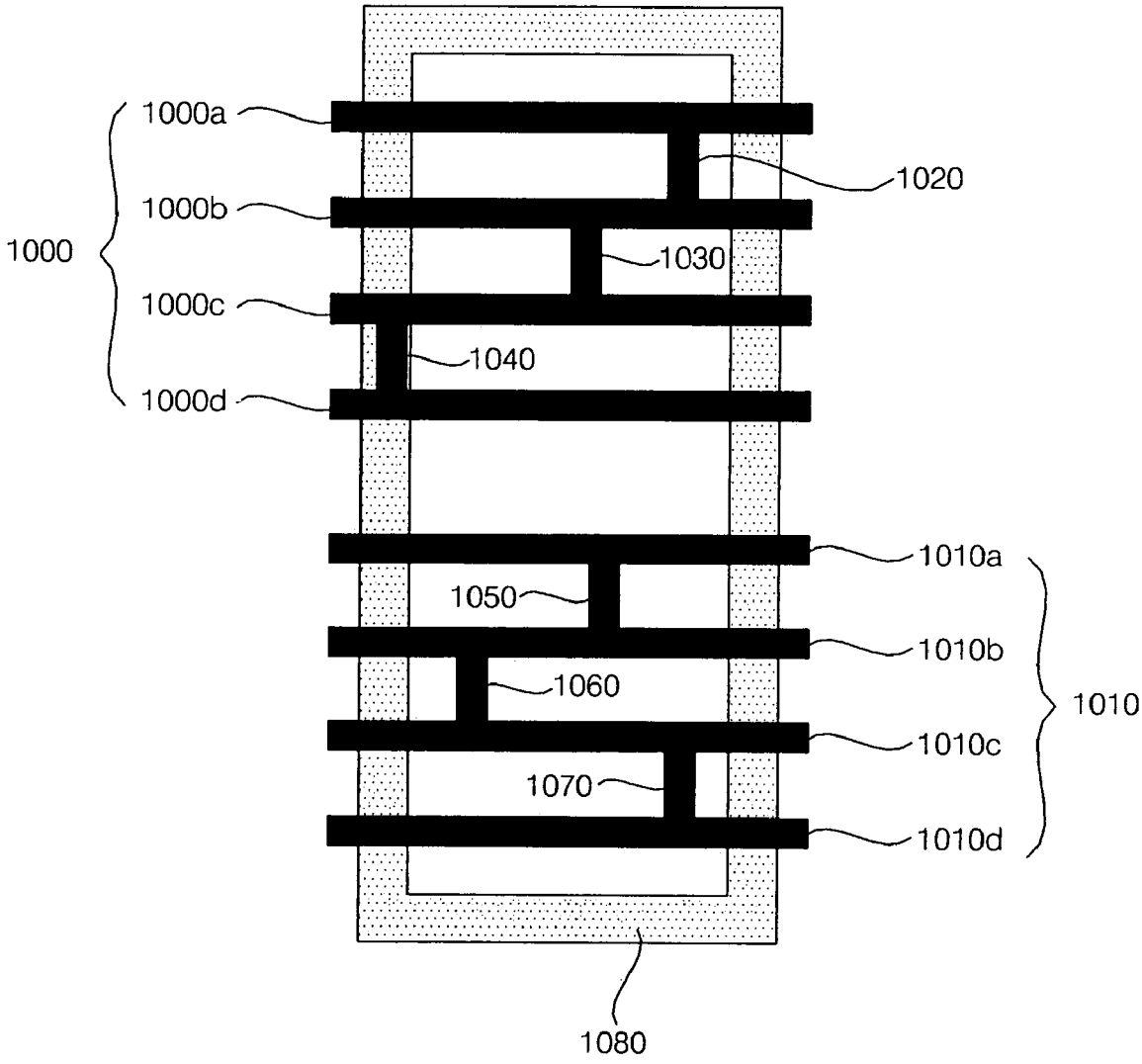
FIG. 10 is a drawing showing a seventh embodiment of the electrode structure of a plasma display panel according to the present invention.

FIG. 10 is a cross-sectional view showing a seventh embodiment of the electrode structure of a plasma display panel according to the present invention.

Each sustain electrode 1000, 1010 includes four electrode lines 1000*a*, 1000*b*, 1000*c*, 1000*d*, 1010*a*, 1010*b*, 1010*c*, 1010*d* crossing the discharge cell. The electrode lines are extended to one direction of the plasma display panel with crossing the discharge cell. It is preferable that the thickness of the electrode lines 1000*a*, 1000*b*, 1000*c*, 1000*d*, 1010*a*, 1010*b*, 1010*c*, 1010*d* of the sustain electrode pair ranges from 3 μm to 7 μm. The critical meaning of the upper limit value and the lower limit value of the thickness of the electrode lines will be omitted since it is identical with the description illustrated in FIG. 2*a*.

The bridge electrodes 1020, 1030, 1040, 1050, 1060, 1070 connect two electrode lines respectively. The bridge electrode 1020, 1030, 1040, 1050, 1060, 1070 helps the generated discharge to be easily diffused to the center of the discharge cell and the remote electrode line. As shown in FIG. 10, the location of the bridge electrodes 1020, 1030, 1040, 1050, 1060, 1070 may not coincide, while one of bridge electrodes 1040 can be positioned on the barrier rib 1080.

Figure 11:
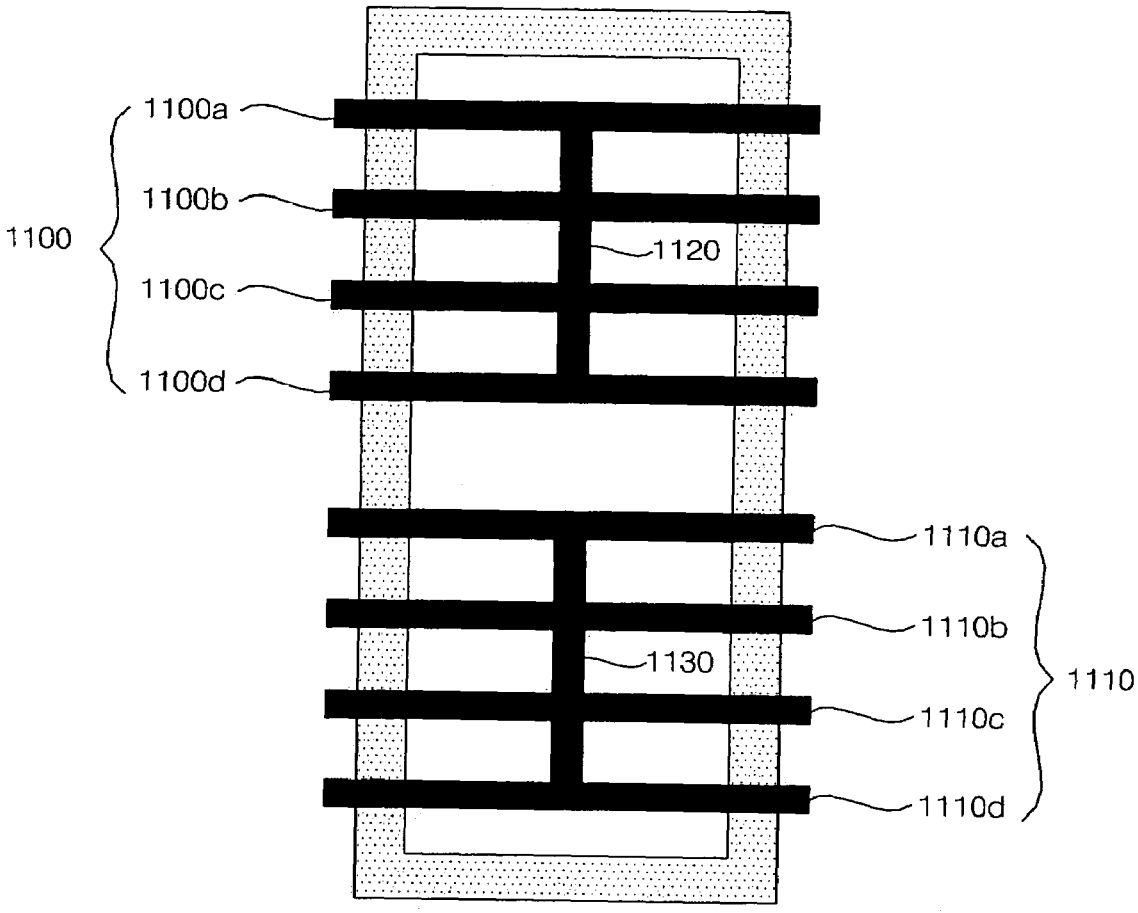
FIG. 11 is a drawing showing a eighth embodiment of the electrode structure of a plasma display panel according to the present invention.

FIG. 11 is a cross-sectional view showing a eighth embodiment of the electrode structure of a plasma display panel according to the present invention. The bridge electrode connecting electrode lines is formed, differently with FIG. 10. That is, one bridge electrode 1120, 1130 connecting four electrode lines 1100*a*, 110*b*, 1100*c*, 1100*d*, 1110*a*, 1110*b*, 1110*c*, 1110*d* to each sustain electrode 1100, 1110 is formed.

It is preferable that the thickness of the electrode lines 1000*a*, 1000*b*, 1000*c*, 1000*d*, 1010*a*, 1010*b*, 1010*c*, 1010*d* of the sustain electrode pair ranges from 3 μm to 7 μm. The critical meaning of the upper limit value and the lower limit value of the thickness of the electrode lines will be omitted since it is identical with the description illustrated in FIG. 2*a*.

Figure 12:
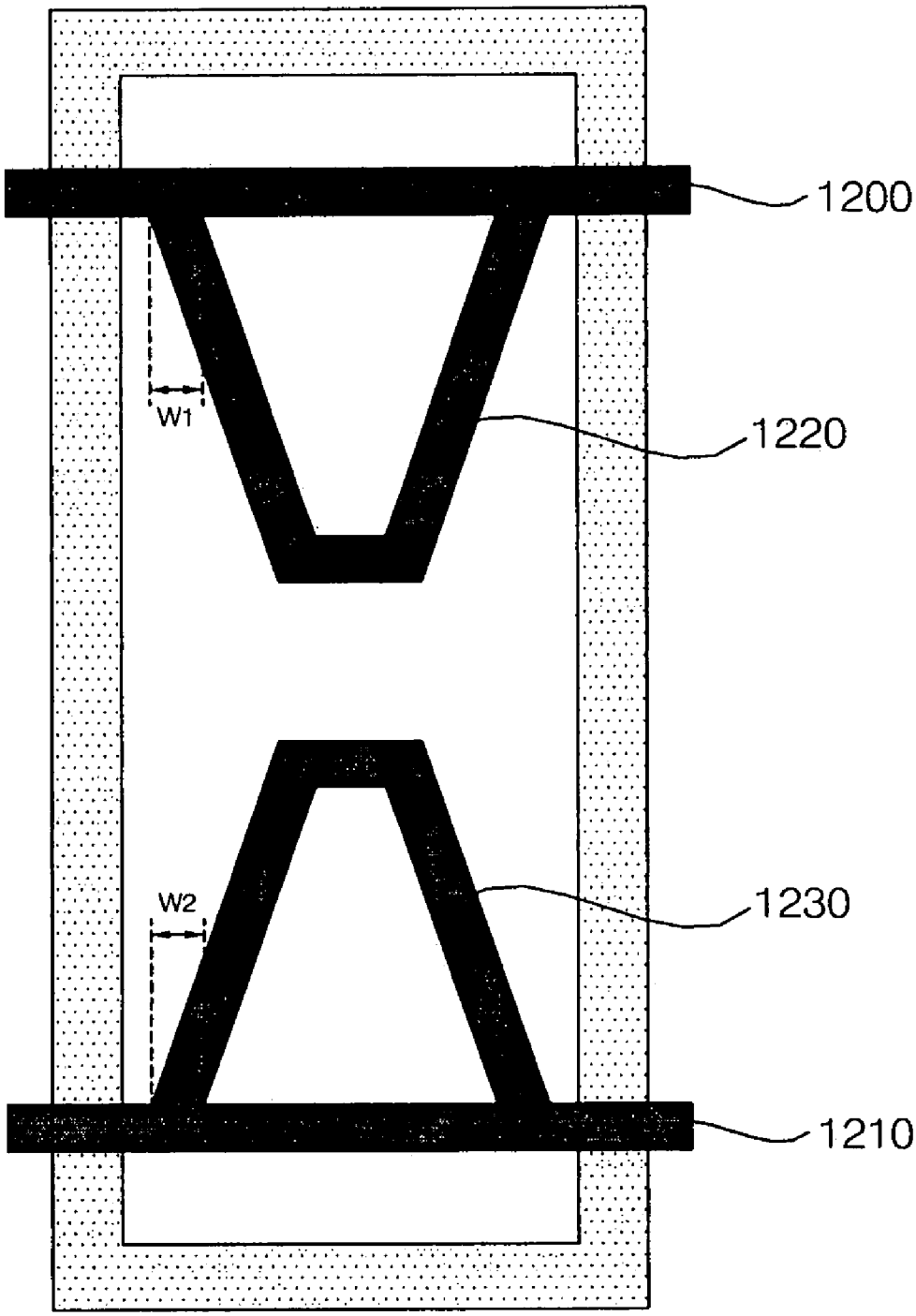
FIG. 12 is a drawing showing a ninth embodiment of the electrode structure of a plasma display panel according to the present invention.

FIG. 12 is a cross-sectional view showing a ninth embodiment of the electrode structure of a plasma display panel according to the present invention.

Projecting electrodes 1220, 1230 including a closed loop for each electrode line 1200, 1210 are formed. The firing voltage can be lowered by projecting electrodes 1220, 1230 including the closed loop as shown in FIG. 12, and, at the same time, the aperture ratio can be improved. The form of the projecting electrode and the closed loop can be variously formed.

It is preferable that the thickness of the electrode lines 1200, 1210 of the sustain electrode pair ranges from 3 μm to 7 μm. The critical meaning of the upper limit value and the lower limit value of the thickness of the electrode lines will be omitted since it is identical with the description illustrated in FIG. 2*a*.

It is preferable that the width W1, W2 of the projecting electrodes 1220, 1230 ranges from 35 μm to 45 μm. In case the width W1, W2 of the projecting electrode 1220, 1230 has such value, by obtaining a sufficient aperture ratio, the light reflected to the front of the plasma display apparatus can be prevented from the reduction of luminance of an image resulting from the blocking of the electrode, It is preferable that the gap of projecting electrode 1220, 1230 ranges from 15 μm to 165 μm. The critical meaning of the upper limit value and the lower limit value of the gap of projecting electrode will be omitted since it is identical with the description illustrated in FIG. 3.

Figure 13:
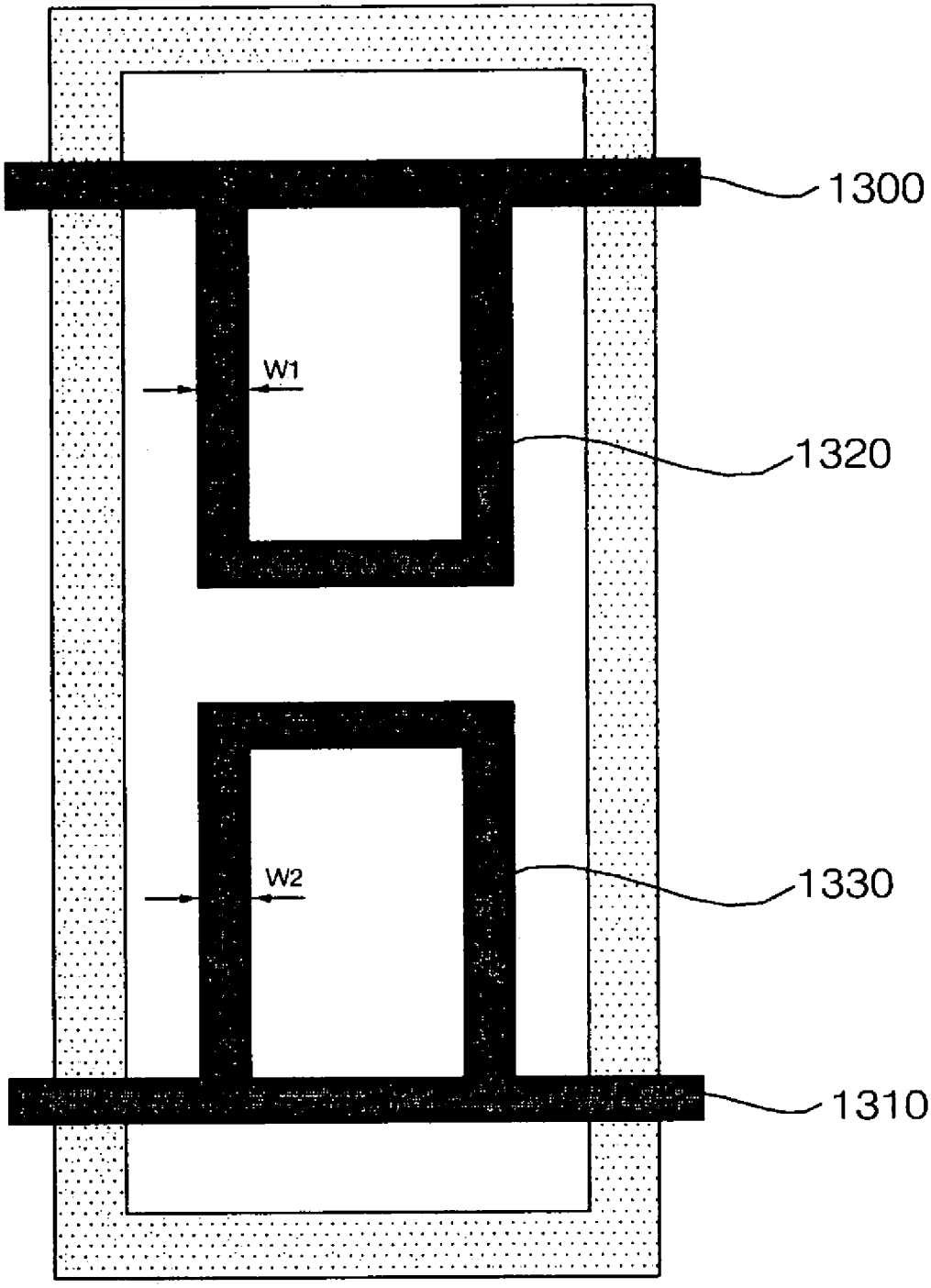
FIG. 13 is a drawing showing a tenth embodiment of the electrode structure of a plasma display panel according to the present invention.

FIG. 13 is a cross-sectional view showing a tenth embodiment of the electrode structure of a plasma display panel according to the present invention.

Projecting electrodes 1320, 1330 including a rectangular loop for each electrode line 1300, 1310 are formed. It is preferable that the thickness of the electrode lines 1320, 1330 of the sustain electrode pair ranges from 3 μm to 7 μm. The critical meaning of the upper limit value and the lower limit value of the thickness of the electrode lines will be omitted since it is identical with the description illustrated in FIG. 2*a*.

It is preferable that the width W1, W2 of the projecting electrodes 1320, 1330 ranges from 35 μm to 45 μm. The critical meaning of the upper limit value and the lower limit value of the width W1, W2 of the projecting electrodes 1320, 1330 will be omitted since it is identical with the description illustrated in FIG. 12.

It is preferable that the gap of projecting electrode 1320, 1330 ranges from 15 μm to 165 μm. The critical meaning of the upper limit value and the lower limit value of the gap of projecting electrode will be omitted since it is identical with the description illustrated in FIG. 3.

Figure 14A:
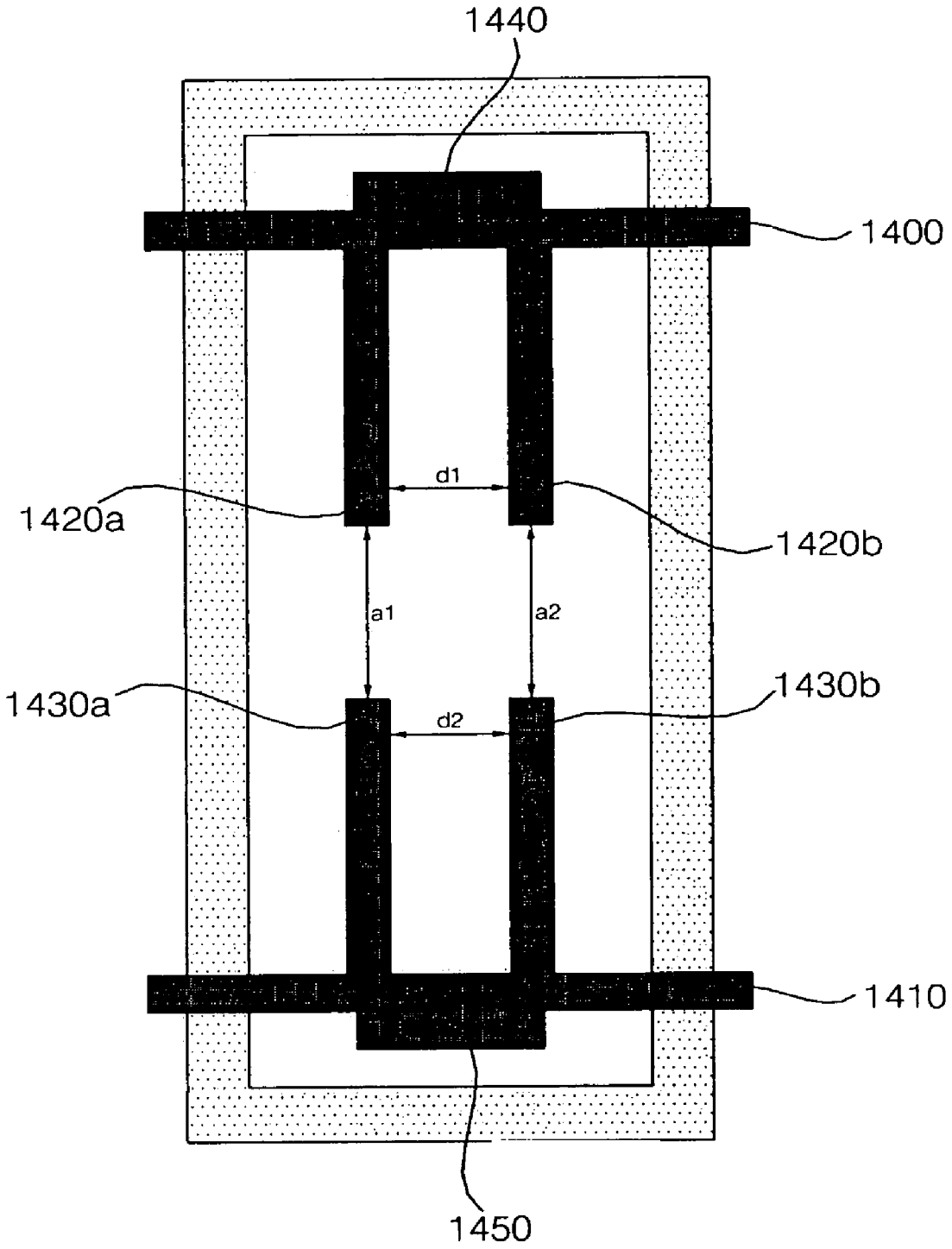
FIG. 14*a* to FIG. 14*b* is a drawing showing an eleventh embodiment of the electrode structure of a plasma display panel according to the present invention.
Figure 14B:
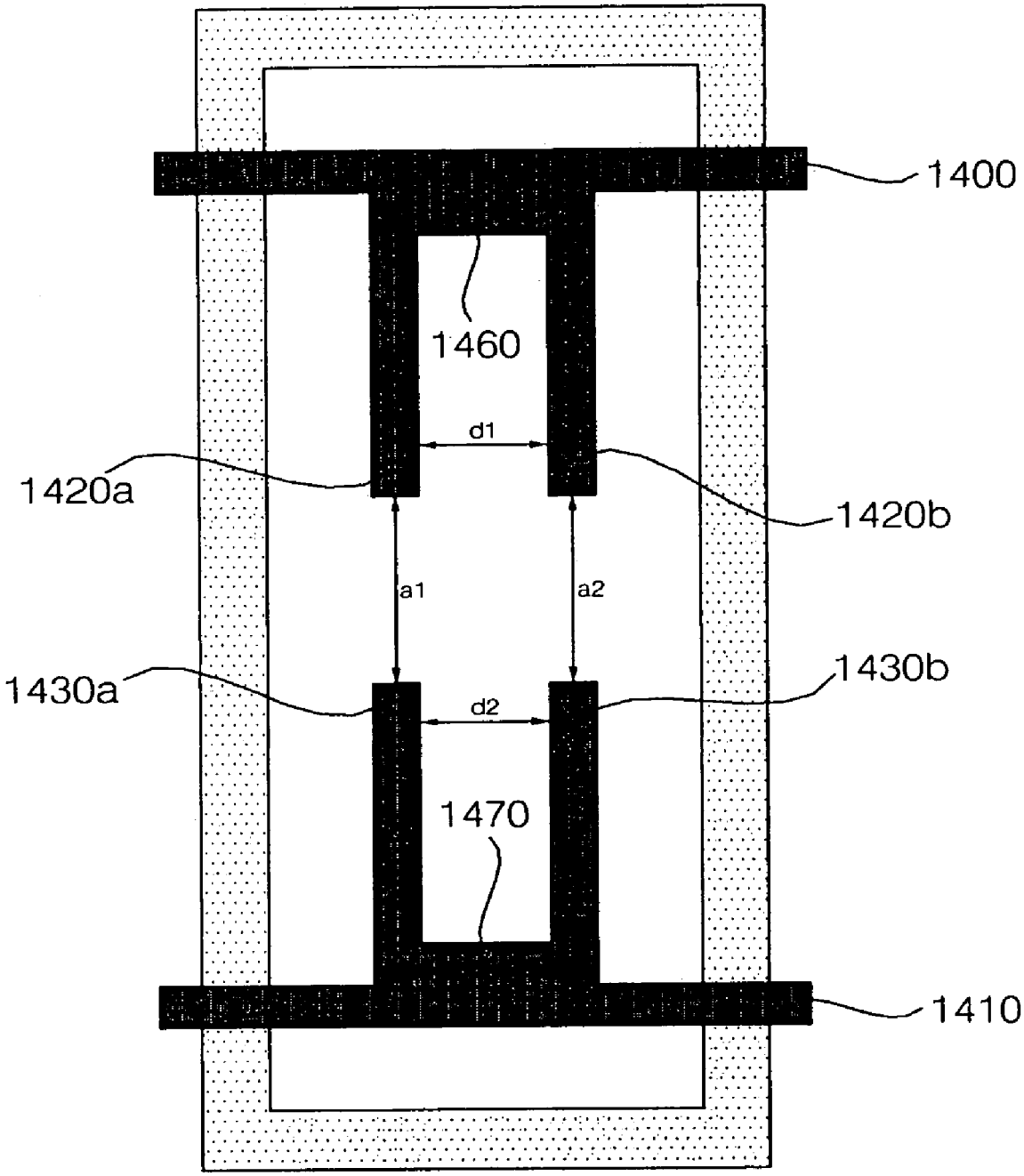

FIG. 14*a* and FIG. 14*b* are a cross-sectional view showing a eleventh embodiment of the electrode structure of a plasma display panel according to the present invention. For each electrode line 1400, 1410, first projecting electrodes 1420*a*, 1420*b*, 1430*a*, 1430*b* protruding to the direction of the center of the discharge cell and second projecting electrodes 1440, 1450, 1460, 1470 protruding to the direction of the center of the discharge cell or in the opposite direction of the center of the discharge cell are formed.

As shown in FIG. 14*a*, it is preferable that, for each electrode line 1400, 1410, two first projecting electrodes 1420*a*, 1420*b*, 1430*a*, 1430*b* protruding to the direction of the center of the discharge cell are formed respectively, while one second projecting electrode 1440, 1450 protruding to the opposite direction of the center of the discharge cell is formed. Further, as shown in FIG. 14*b*, the second projecting electrode 1460, 1470 can be protruded to the center of the discharge cell.

It is preferable that the thickness of the electrode lines 1400, 1410 of the sustain electrode pair ranges from 3 μm to 7 μm. The critical meaning of the upper limit value and the lower limit value of the thickness of the electrode lines will be omitted since it is identical with the description illustrated in FIG. 2*a*.

It is preferable that the width of the first projecting electrodes 1420*a*, 1420*b*, 1430*a*, 1430*b* ranges from 35 μm to 45 μm. The critical meaning of the upper limit value and the lower limit value of the width of the projecting electrodes will be omitted since it is identical with the description illustrated in FIG. 4.

it is preferable that the gap d1, d2 of the two first projecting electrodes protruded from one electrode line ranges from 50 μm to 100 μm in case the plasma display panel has the size of 42 inch with the resolution of VGA. In case the plasma display panel has the size of 42 inch with the resolution of XGA, it is preferable that the gap d1, d2 of the first projecting electrode ranges from 50 μm to 100 μm. In case the plasma display panel has the size of 50 inch with the resolution of XGA, it is preferable that the gap d1, d2 of the first projecting electrode ranges from 40 μm to 90 μm.

The critical meaning of the upper limit value and the lower limit value of the gap d1, d2 of the first projecting electrode will be omitted since it is identical with the description illustrated in FIG. 6.

It is preferable that the gap of another first projecting electrodes, that is, the gap a1 between 1420*a* and 1430*a*, or the gap a2 between 1420*b* and 1430*b* ranges from 15 μm to 165 μm. The critical meaning of the upper limit value and the lower limit value of the gap of the projecting electrodes will be omitted since it is identical with the description illustrated in FIG. 3.

Figure 15:
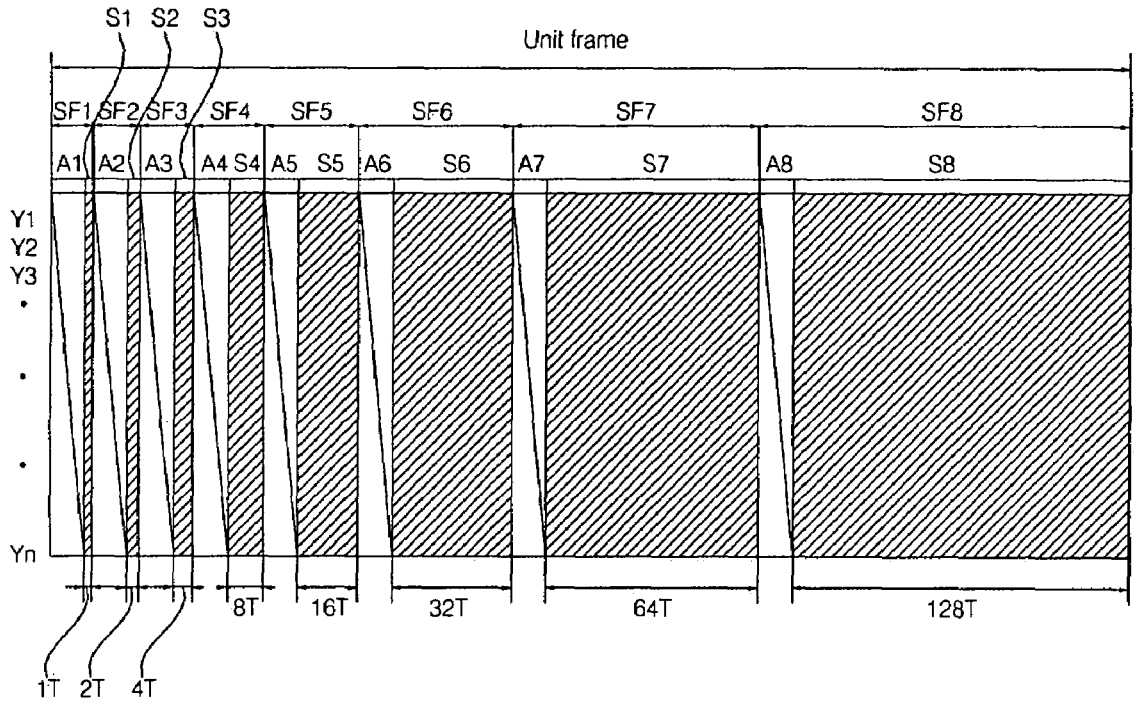
FIG. 15 is a drawing showing an embodiment of the method in which a frame is time-divided into a plurality of subfields for driving a plasma display panel.

FIG. 15 is a drawing showing an embodiment of the method in which a frame of an image of a plasma display panel is time-divided into a plurality of subfields for driving in according to the present invention having the structure described above.

The unit frame can be time-divided driven with a predetermined number, for example, eight subfields SF1, SF8 so as to express the gray level of an image. Further, each subfield SF1, . . . , SF8 is divided into a reset period (not shown), an address period A1, . . . , A8, and a sustain period S1, . . . , S8.

In each address period A1, . . . , A8, a data signal is applied to the address electrode X, while a scan pulse corresponding to it is sequentially applied to each scan electrode Y. In each sustain period S1, . . . , S8, the sustain pulse is alternately applied to the scan electrode Y and the sustain electrode Z such that the sustain discharge is generated in discharge cells selected in the address period Al, . . . , A8.

The luminance of the plasma display panel is in proportion to the number of sustain discharge pulse of the sustain period S1, . . . , S8 in the unit frame. In case one frame forming one image is expressed with 8 subfields and 256 gray level, the sustain pulse having a different number can be allocated to each subfield with the rate of 1, 2, 4, 8, 16, 32, 64, 128. To obtain the luminance of 133 gray level, cells are addressed to generate a sustain discharge during the subfield 1 period, the subfield 3 period, and the subfield 8 period.

In the meantime, according to the weighted value of the subfields by Automatic Power Control APC step, the number of sustain discharge allocated to each subfield can be variably determined. That is, in FIG. 15, it was exemplified that a frame is divided into 8 subfields. However, the invention is not restricted to that. Hence, the number of the subfield forming a frame can be variously changed according to the design type. For example, it can be divided into below or over 8 subfields such as 12 subfields or 16 subfields to drive the plasma display panel.

In addition, the number of sustain discharge allocated to each subfield can be variously changed in consideration of the gamma characteristics or the panel characteristics. For example, the gray level allocated to the subfield 4 can be lowered from 8 to 6, while the gray level allocated to the subfield 6 can be enhanced from 32 to 34.

Pre reset period exists to form positive wall charges on the scan electrode Y and to form positive wall charge on the sustain electrode Z. Thereafter, by using the wall charge distribution formed by the pre reset period, each subfield includes a reset period for initializing the discharge cells of the full screen, an address period for selecting the discharge cell, and a sustain period for maintaining the discharge of the selected discharge cells.

The reset period is comprised of a setup period and a set down period. In the set up period, ramp-up waveforms are simultaneously supplied to all the scan electrodes to generate a micro discharge in the discharge cell. Accordingly, the wall charges are generated.

In the set down period, at the same time, the ramp-down waveforms falling from the positive polarity voltage lower than the peak voltage of the ramp-up waveform are simultaneously supplied to all of the scan electrodes Y to generate an erase discharge in all discharge cells. Accordingly, electric charges which are not necessary are deleted among the wall charge generated by the set up discharge and the space charge.

In the address period, the scan signal scan of the negative polarity is sequentially supplied to the scan electrode, while, simultaneously, the data signal data of the positive polarity is supplied to the address electrode X. The address discharge is generated and a cell is selected due to the voltage difference between the scan signal scan and the data signal data and the wall voltage generated during the reset period.

In the meantime, during the set down period and the address period, a signal maintaining the sustain voltage Vs is supplied to the sustain electrode.

In the sustain address, the sustainer pulse is alternately supplied to the scan electrode and the sustain electrode to generate a sustain discharge with a surface discharge type between the scan electrode and the sustain electrode.

Figure 16:
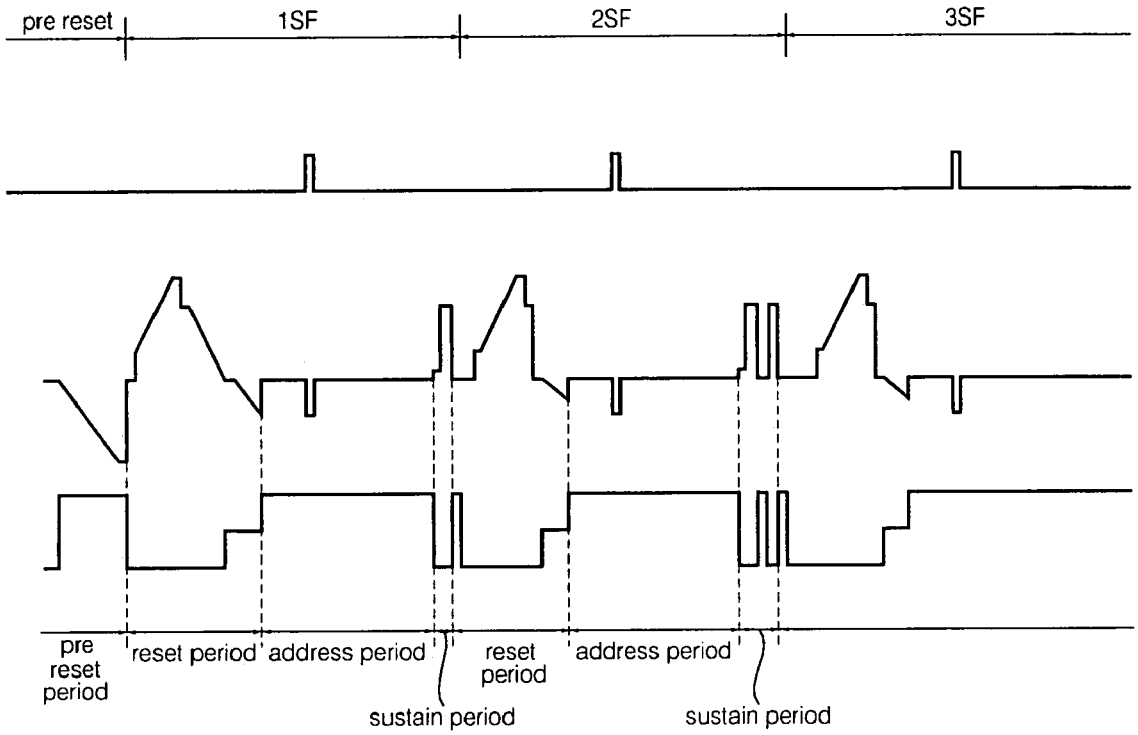
FIG. 16 is a waveform diagram showing an embodiment of driving signals for driving a plasma display panel.

FIG. 16 is a waveform diagram showing an embodiment of driving signals for driving a plasma display panel, the invention is not restricted by waveforms shown in FIG. 16.

For example, the pre reset period can be omitted. The polarity and voltage level of the signals shown in FIG. 16 can be changed, if necessary. The erase signal for the wall charge elimination after the sustain discharge is completed can be supplied to the sustain electrode. In addition, the single sustain drive mode in which the sustain discharge can be supplied to one of the scan electrode Y and the sustain Z electrode to generate a sustain discharge can be used.

As described in the above, according to the panel equipped in the plasma display apparatus of the present invention, by removing the transparent electrode consisting of ITO, the manufacturing cost of the plasma display panel can be diminished. By forming projecting electrodes protruded to the opposite direction of the center of the discharge cell or in the direction of the center of the discharge cell from the sustain electrode line or the scan electrode, the firing voltage can be lowered, and the discharge diffusion efficiency in the discharge cell can be increased.

It will be apparent to those skilled in the art that various modifications and variation can be made in the present invention without departing from the spirit or scope of the present invention. Thus, it is intended that the present invention cover the modifications and variations of this invention provided they come within the scope of the appended claims and their equivalents.

What is claimed is:

1. A plasma display apparatus, comprising:

a front substrate;

a plurality of first sustain electrodes and a plurality of second sustain electrodes formed on the front substrate;

a rear substrate positioned adjacent to the front substrate;

a plurality of address electrodes formed on the rear substrate;

at least one column barrier rib at least substantially parallel with the address electrodes and at least one row barrier rib crossing the address electrodes; and a plurality of discharge cells positioned where the pluralities of first and second sustain electrodes cross the plurality of address electrode, the first and second sustain electrodes not overlapping the row barrier rib, wherein at least one of the plurality of first sustain electrodes or the plurality of second sustain electrodes is formed of one layer with a bus electrode, and wherein a thickness of the at least one of the plurality of first sustain electrodes or the second sustain electrodes ranges from ~3 μm to ~7 μm, said apparatus further comprising:

a first bridge portion that crosses at least one of the first sustain electrodes; and a second bridge portion that crosses at least one of the second sustain electrodes, wherein:

the first and second bridge portions have first ends that extend toward one another and beyond respective ones of the first and second sustain electrodes, the first ends aligned at least substantially along a common axis to define a gap, the first ends project beyond respective ones of the first and second sustain electrodes by distances sufficient to correspond to a predetermined firing voltage for driving the plasma display apparatus, and the first and second bridge portions have second ends that extend in directions different from the first ends of the first and second bridge portions, the second ends extending towards corresponding row barrier ribs of a discharge cell leaving respective gaps therebetween, wherein each of the gaps is ~70 μm or less.

2. The plasma display apparatus of claim 1, wherein a resistance of at least one of the first or second sustain electrodes ranges from ~50Ω to ~65Ω.

3. The plasma display apparatus of claim 1, wherein a resistance of at least one of the first or second sustain electrodes ranges from ~40Ω to ~90Ω.

4. The plasma display apparatus of claim 3, wherein said resistance corresponds to a resistance between ends of the at least one of the first or second electrodes positioned in an effective display region of the panel.

5. The plasma display apparatus of claim 1, wherein at least one of the first or second sustain electrodes comprises two or more line portions, and a gap between adjacent line portions among the two or more line portions ranges ~80 μm to ~120 μm.

6. The plasma display apparatus of claim 1, wherein each of the first ends forms at least one closed loop.

7. The plasma display apparatus of claim 1, further comprising a front dielectric layer covering the pluralities of first and second sustain electrodes, wherein at least one of the first or second sustain electrodes is darker than the front dielectric layer.

8. The plasma display apparatus of claim 1, further comprising, formed on the rear substrate:

a dielectric layer;

at least one barrier rib partitioning off the plurality of discharge cells; and a phosphor layer.

9. A plasma display apparatus, comprising:

a front substrate;

a plurality of first sustain electrodes and a plurality of second sustain electrodes formed on the front substrate;

a rear substrate positioned adjacent to the front substrate;

a plurality of address electrodes formed on the rear substrate; and a column barrier rib at least substantially parallel to the address electrodes, and a row barrier rib crossing the address electrodes;

wherein at least one of the first or second sustain electrodes comprises:

at least one line portion formed in a direction crossing the plurality of address electrodes; and at least one protrusion portion that protrudes from one of at least one line portions, wherein:

at least one of the plurality of first sustain electrodes or the plurality of second sustain electrodes is formed of one layer with a bus electrode, a width of the at least one protrusion portion ranges from ~35 μm to ~70 μm, the at least one protrusion protrudes from the at least one line portion by a distance sufficient to correspond to a predetermined firing voltage for driving the plasma display apparatus, and the at least one protrusion portion comprises at least two protrusion portions, at least one first protrusion portion extending toward a center of the respective discharge cell and at least one second protrusion portion extending toward the row barrier rib of the respective discharge cell leaving a gap therebetween, wherein the gap is ~70 μm or less.

10. The plasma display apparatus of claim 9, wherein a width of the at least one protrusion portion ranges from ~35 μm to ~45 μm.

11. The plasma display apparatus of claim 9, wherein the at least one first protrusion portion comprises two or more protrusion portions.

12. The plasma display apparatus of claim 9, wherein the at least one protrusion portion forms at least one closed loop.

13. A plasma display apparatus, comprising:

a front substrate;

a plurality of first sustain electrodes and a plurality of second sustain electrodes formed on the front substrate;

a rear substrate positioned adjacent to the front substrate;

a plurality of address electrodes formed on the rear substrate;

a column barrier rib at least substantially parallel to the address electrodes and a row barrier rib crossing the address electrodes;

at least one line portion formed in a direction crossing the plurality of address electrodes; and at least one protrusion portion that protrudes from the at least one line portion, wherein:

the at least one protrusion portion comprises at least two protrusion portions, at least one first protrusion portion extending towards a center of the respective discharge cell and at least one second protrusion portion extending towards the row barrier rib of the respective discharge cell leaving a gap therebetween, wherein the gap is ~70 μm or less, at least one of the plurality of first sustain electrodes or the plurality of second sustain electrodes is formed of one layer with a bus electrode, a gap between a protrusion portion of one of the first sustain electrodes and a protrusion portion of one of the second sustain electrodes ranges from ~15 μm to ~165 μm, the at least one protrusion protrudes from the at least one line portion by a distance sufficient to correspond to a predetermined firing voltage for driving the plasma display apparatus.

14. The plasma display apparatus of claim 13, wherein the gap between the first protrusion portion of the one of the first sustain electrodes and the first protrusion portion of the one of the second sustain electrode ranges from ~60 μm to ~120 μm.

15. The plasma display apparatus of claim 13, further comprising a front dielectric layer that covers the pluralities of first and second sustain electrodes, wherein at least one of the first or second sustain electrodes is darker than the front dielectric layer.

16. The plasma display apparatus of claim 13, wherein the at least one protrusion portion forms at least one closed loop.

17. A plasma display apparatus, comprising:

a front substrate;

a plurality of first sustain electrodes and a plurality of second sustain electrodes formed on the front substrate;

a rear substrate positioned adjacent to the front substrate; and a plurality of address electrodes formed on the rear substrate a column barrier rib at least substantially parallel to the address electrodes and a row barrier rib crossing the address electrodes;

at least one line portion formed in a direction crossing the plurality of address electrodes; and at least one protrusion portion that protrudes from the at least one line portion in a direction of a plurality of barrier rib which is positioned adjacent to the at least one line portion, wherein at least one of the plurality of first sustain electrodes or the plurality of second sustain electrodes is formed of one layer with a bus electrode, wherein a length of the at least one protrusion portion ranges from ~30 μm to ~100 μm, said length of the at least one protrusion portion sufficient to correspond to a predetermined firing voltage for driving the plasma display apparatus, and wherein the at least one protrusion portion comprises at least two protrusion portions, at least one first protrusion portion extending toward a center of the respective discharge cell and at least one second protrusion portion extending toward the row barrier rib of the respective discharge cell leaving a gap therebetween, wherein the gap is ~70 μm or less.

18. The plasma display apparatus of claim 17, wherein a length of the at least one protrusion portion ranges from ~50 μm to ~100 μm.

19. The plasma display panel of claim 1, wherein at least one of the first or second sustain electrodes includes at least one line portion, and wherein the at least one line portion comprises at least two line portions.

20. The plasma display panel of claim 19, wherein the at least two line portions are connected by at least one bridge portion.

21. The plasma display panel of claim 1, wherein the one layer comprises an opaque metal.

22. The plasma display panel of claim 1, wherein the one layer comprises silver.

23. The plasma display apparatus of claim 1 wherein no intervening electrodes are formed between the first ends of the first and second bridge portions in a plane that at least substantially includes the first and second bridge portions and the pluralities of first and second sustain electrodes.

24. A plasma display apparatus, comprising:

a front substrate;

a plurality of first sustain electrodes and a plurality of second sustain electrodes formed on the front substrate;

a rear substrate positioned adjacent to the front substrate;

a plurality of address electrodes formed on the rear substrate;

a column barrier rib at least substantially parallel to the address electrodes and a row barrier rib crossing the address electrodes; and a plurality of discharge cells positioned where the pluralities of first and second sustain electrodes intersect with the plurality of address electrodes, wherein at least one of the plurality of first sustain electrodes or the plurality of second sustain electrodes is formed of one layer with a bus electrode, and wherein a thickness of the at least one of the plurality of first sustain electrodes or the second sustain electrodes ranges from ~3 μm to ~7 μm, said apparatus further comprising:

a first bridge portion that crosses at least one of the first sustain electrodes; and a second bridge portion that crosses at least one of the second sustain electrodes, wherein first and second bridge portions have first ends that extend toward one another and beyond respective ones of the first and second sustain electrodes, the first ends aligned at least substantially along a common axis to define a gap, wherein the first ends project beyond respective ones of the first and second sustain electrodes by distances sufficient to correspond to a predetermined firing voltage for driving the plasma display apparatus, wherein:

the first ends of the first and second bridge portions are tapered ends, each of said tapered ends having a first width that reduces to a second width along continuous curved surfaces and wherein each of the tapered ends has rounded tips, the first and second bridge portions have second ends that extend in directions different from the first ends of the first and second bridge portions, the second ends extending towards corresponding row barrier ribs of a discharge cell leaving respective gaps therebetween, wherein each of the gaps is ~70 μm or less.

25. The plasma display apparatus of claim 1, wherein the first ends and the second ends extend in opposing directions.

26. The plasma display apparatus of claim 1, wherein at least one of the first ends or the second ends of the first and second bridge portions have a curved shape.

27. The plasma display apparatus of claim 1, wherein a number of first sustain electrodes and a number of second sustain electrodes correspond to a predetermined aperture ratio.

28. The plasma display apparatus of claim 1, wherein a number of first sustain electrodes and a number of second sustain electrodes correspond to a predetermined discharge diffusion efficiency.

29. The plasma display apparatus of claim 1, further comprising: a dielectric layer covering the pluralities of first and second sustain electrodes, wherein the first and second sustain electrodes have a light permeability less than a light permeability of the dielectric layer.

30. The plasma display apparatus of claim 1, wherein the pluralities of first and second sustain electrodes are arranged in substantially a same plane.

31. The plasma display apparatus of claim 1, wherein the pluralities of first and second sustain electrodes are made from at least one opaque material.

32. The plasma display apparatus of claim 1, further comprising: a black layer that separates the first and second sustain electrodes from the front substrate.

33. The plasma display apparatus of claim 32, further comprising: a black matrix coupled to the front substrate and having an anti-reflection property.

34. The plasma display apparatus of claim 33, wherein the black matrix is made from a same material as the black layer.

35. A plasma display apparatus, comprising:

a front substrate;

a plurality of first sustain electrodes and a plurality of second sustain electrodes formed on the front substrate;

a rear substrate positioned adjacent to the front substrate;

a plurality of address electrodes formed on the rear substrate;

a plurality of discharge cells positioned where the pluralities of first and second sustain electrodes cross the plurality of address electrode, wherein at least one of the plurality of first sustain electrodes or the plurality of second sustain electrodes is formed of one layer with a bus electrode, and wherein a thickness of the at least one of the plurality of first sustain electrodes or the second sustain electrodes ranges from ~3 μm to ~7 μm, said apparatus further comprising:

a first bridge portion that crosses at least one of the first sustain electrodes; and a second bridge portion that crosses at least one of the second sustain electrodes, wherein:

first and second bridge portions have first ends that extend toward one another and beyond respective ones of the first and second sustain electrodes, the first ends aligned at least substantially along a common axis to define a gap, the first ends project beyond respective ones of the first and second sustain electrodes by distances sufficient to correspond to a predetermined firing voltage for driving the plasma display apparatus, a black layer that separates the first and second sustain electrodes from the front substrate, and a black matrix coupled to the front substrate and having an anti-reflection property, wherein the black matrix is made from a different material from the black layer.

36. The plasma display apparatus of claim 32, wherein the black layer includes a property that achieves a predetermined metachromatism of the plasma display apparatus.

37. The plasma display apparatus of claim 1, wherein one of the first sustain electrodes or the second sustain electrodes operate as scan electrodes.

* * * * *